US010962274B2

(12) United States Patent
Shin

(10) Patent No.: US 10,962,274 B2
(45) Date of Patent: Mar. 30, 2021

(54) MULTI-DUCT ASSEMBLY, REFRIGERATOR INCLUDING THE MULTI-DUCT ASSEMBLY, AND METHOD OF CONTROLLING THE REFRIGERATOR

(71) Applicant: LG ELECTRONICS INC., Seoul (KR)

(72) Inventor: Gyuwon Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 341 days.

(21) Appl. No.: 15/845,758

(22) Filed: Dec. 18, 2017

(65) Prior Publication Data

US 2018/0180346 A1 Jun. 28, 2018

(30) Foreign Application Priority Data

Dec. 22, 2016 (KR) ..... 10-2016-0176993

(51) Int. Cl.
*F25D 17/06* (2006.01)

(52) U.S. Cl.
CPC ..... *F25D 17/065* (2013.01); *F25D 17/062* (2013.01); *F25B 2600/0251* (2013.01); *F25D 2317/063* (2013.01); *F25D 2317/067* (2013.01); *F25D 2317/0672* (2013.01); *F25D 2600/06* (2013.01); *F25D 2700/12* (2013.01)

(58) Field of Classification Search
CPC .. F25D 2317/063; F25D 17/062; F25D 17/00; F25D 17/065; F25D 2600/06; F25D 2600/0251; F25D 2317/0672; F25D 2317/067; F25D 2700/12
See application file for complete search history.

(56) References Cited

U.S. PATENT DOCUMENTS 5,678,421 A * 10/1997 Maynard ..... A47F 3/0408 62/279
6,301,910 B1 * 10/2001 Noritake ..... F25D 17/045 62/182
6,634,181 B2 * 10/2003 Kim ..... F25D 17/065 62/407
2003/0230104 A1 * 12/2003 Morse ..... F25D 19/00 62/277
2010/0162747 A1 * 7/2010 Hamel ..... F25D 11/022 62/441
2017/0314842 A1 * 11/2017 Lee ..... F25D 17/062
2018/0306484 A1 * 10/2018 Cha ..... F25D 17/065

FOREIGN PATENT DOCUMENTS

KR 2009-0100773 A 9/2009
KR 20090100773 A * 9/2009

* cited by examiner

*Primary Examiner* — Steven S Anderson, II
(74) *Attorney, Agent, or Firm* — Finnegan, Henderson, Farabow, Garrett & Dunner, LLP

(57) ABSTRACT

Disclosed are a multi-duct assembly, a refrigerator which includes the multi-duct assembly, and a method of controlling the refrigerator. The multi-duct assembly has a new structure for overcoming limitations of a related art. The multi-duct assembly may adjust opening states and sizes of cold air outlets formed at a multi-duct panel by moving a variable duct panel disposed on a rear surface of the multi-duct panel upward or downward.

10 Claims, 22 Drawing Sheets

MULTI-DUCT ASSEMBLY, REFRIGERATOR INCLUDING THE MULTI-DUCT ASSEMBLY, AND METHOD OF CONTROLLING THE REFRIGERATOR

CROSS-REFERENCE TO RELATED APPLICATION

This application claims benefit of priority of Korean Patent Application No. 10-10-2016-0176993, filed on Dec. 22, 2016, the disclosure of which is incorporated herein by reference in its entirety.

BACKGROUND

1. Field of the Invention

The present invention relates to are a multi-duct assembly, a refrigerator which includes the multi-duct assembly, and a method of controlling the refrigerator.

2. Discussion of Related Art

Refrigerators are apparatuses capable of keeping items fresh for a certain period by cooling a freezer compartment or a storage compartment at a certain temperature through repeated freezing or refrigerating cycles. Generally, a refrigerator includes a body which forms a storage compartment and a door which opens or closes the storage compartment. The storage compartment stores items such as food, and a user may open the door to store items or withdraw the stored items.

To decrease a temperature in the storage compartment, the refrigerator includes an evaporator. The evaporator decreases an ambient temperature by using cold air generated by circulating a refrigerant which flows through a cooling pipe. A refrigerant with a low pressure and low temperature, which flows through the evaporator, absorbs ambient heat and generates cold air while evaporating. The cold air generated as described above flows into the storage compartment through an internal flow path and cools items stored in the storage compartment to a certain temperature.

Here, the cold air generated by the evaporator is discharged into the storage compartment through one or more cold air outlets formed at a multi-duct panel disposed on a rear surface of the storage compartment. However, cold air outlets formed at a multi-duct panel provided in a conventional refrigerator are constantly open regardless of the amount of items stored in the storage compartment or an internal temperature of the storage compartment. That is, according to a related art, because it is not possible to adjust an opening state or a size of each of cold air outlets, cold air is discharged or not discharged through all of the cold air outlets.

However, the conventional refrigerator includes one or more shelves for partitioning an inside of the storage compartment, and the storage compartment includes one or more storage cells partitioned by the shelves. Accordingly, a user stores food and the like in each of the storage cell. For example, when the user stores warm food only in one storage cell among a plurality of such storage cells provided in the refrigerator, a compressor is driven according to an increase in a temperature in the storage compartment and cold air is generated through an evaporator.

However, according to the related art, cold air is supplied through all of the cold air outlets formed at the multi-duct panel to cool the warm food stored in the one storage cell.

Accordingly, since cooling is performed for all of the storage cells, energy is unnecessarily consumed for cooling the food. Also, due to newly stored food, food previously stored in another storage cell is overcooled.

SUMMARY OF THE INVENTION

It is an aspect of the present invention to provide a multi-duct assembly capable of adjusting an opening state and a size of a cold air outlet, a refrigerator including the multi-duct assembly, and a method of controlling the refrigerator.

It is another aspect of the present invention to provide a multi-duct assembly capable of adjusting an opening state and a size of a cold air outlet to cool a particular storage cell of a storage compartment according to a selection of a user or a temperature for each storage cell, a refrigerator including the multi-duct assembly, and a method of controlling the refrigerator.

It is still another aspect of the present invention to provide a multi-duct assembly capable of preventing power consumption for unnecessary cooling of a storage cell and an overcooling phenomenon of stored items by adjusting an opening state and a size of a cold air outlet to cool a particular storage cell in consideration of a temperature for each storage cell, a refrigerator including the multi-duct assembly, and a method of controlling the refrigerator.

Aspects of the present invention are not limited to the above-described aspects, and other aspects and advantages of the present invention will be understood by the following description and will be more definitely understood through the embodiments of the present invention. Also, it will be easily appreciated that the aspects and advantages of the present invention may be implemented by means shown in the claims and a combination thereof.

As described above, it is impossible to adjust an opening state or a size of a cold air outlet formed at a multi-duct panel provided in a conventional refrigerator. Accordingly, it is impossible to perform control of a temperature for each storage cell in the conventional refrigerator.

The present invention provides a multi-duct assembly having a new structure for overcoming limitations of related art. The multi-duct assembly may adjust opening states and sizes of cold air outlets formed at the multi-duct panel by moving a variable duct panel disposed on a rear surface of the multi-duct panel upward or downward.

According to one aspect of the present invention, the variable duct panel may include one or more adjustable cold air openings formed therein. When the variable duct panel moves upward or downward to allow the adjustable cold air openings to be in communication with the cold air outlets, the cold air outlets may be opened, but the cold air outlets are otherwise closed.

The multi-duct assembly may include a structure capable of selectively opening a particular cold air outlet according to a cooling mode selected by a user or an internal temperature of each storage cell. A refrigerator including the multi-duct assembly according to one aspect of the present invention may cool a particular storage cell according to a cooling mode selected by a user or an internal temperature of each storage cell.

The refrigerator having the above-described structure according to one aspect of the present invention may operate in an intensive cooling mode and an automatic cooling mode. When the user selects the intensive cooling mode and then selects a storage cell to be cooled, that is, a storage cell which is an object of cooling, only a cold air outlet corresponding to the storage cell, which is the object of cooling and selected by the user among the cold air outlets formed in the multi-duct assembly, is opened, and then a cooling operation is performed.

Also, when the user selects the automatic cooling mode, the refrigerator automatically determines a storage cell which needs cooling, that is, a storage cell which is an object of cooling, according to the internal temperature of each of the storage cells, opens only a cold air outlet corresponding to the determined storage cell which is the object of cooling, and performs the cooling operation.

Particularly, the multi-duct assembly has an advantage in that a size of a cold air outlet is adjusted as necessary. According to one aspect of the present invention, an opening area of the cold air outlet may be adjusted to have an area corresponding to an amount of cold air which flows into a storage cell. For example, when the user selects a power-saving mode operation for saving energy, the amount of cold air which flows into the storage cell may be set to be smaller than that when performing the above-described intensive cooling or automatic cooling, and the opening area of the cold air outlet may be adjusted to be smaller than before according to the set amount of cold air.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
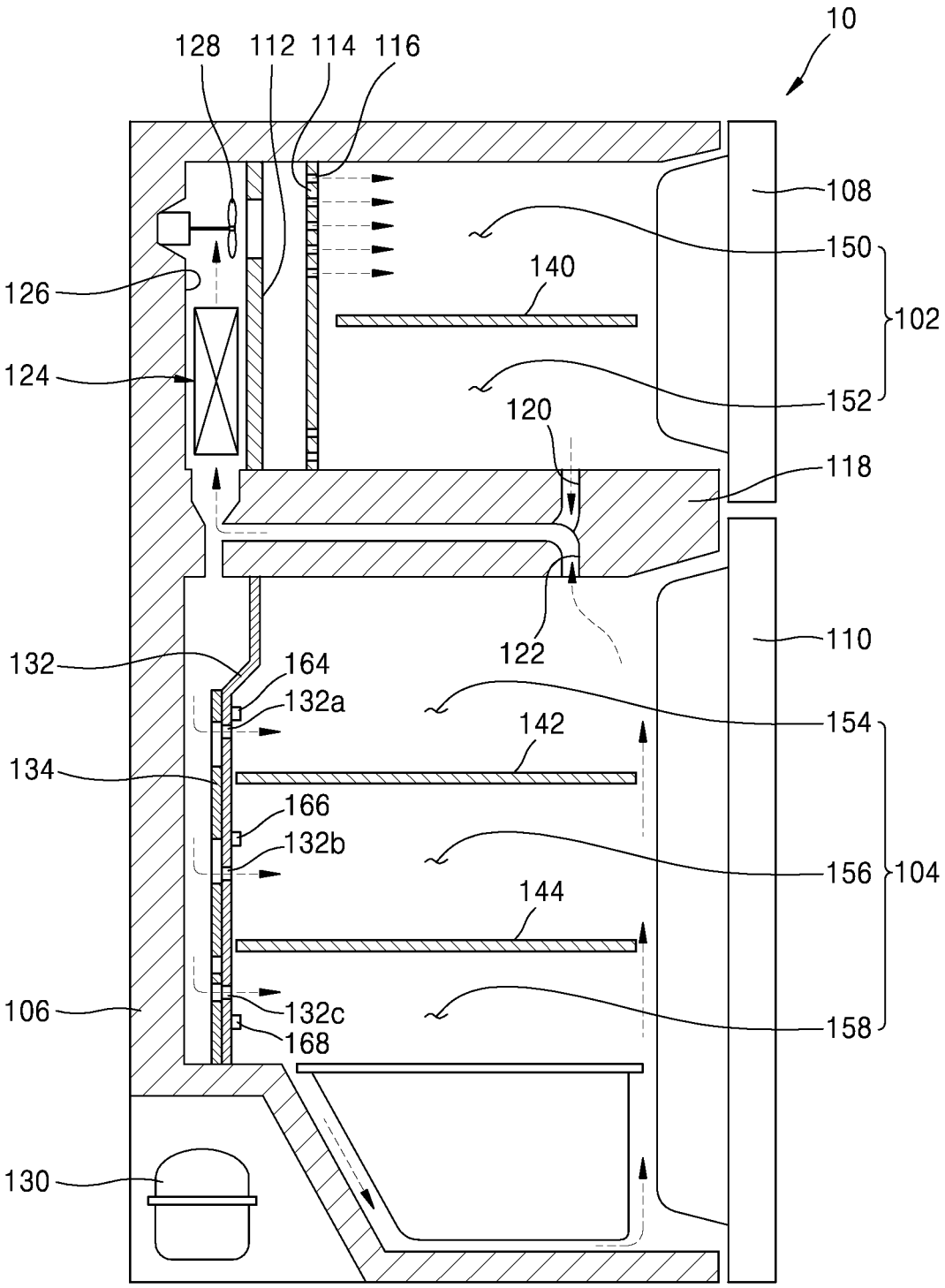
FIG. 1 is a longitudinal cross-sectional view schematically illustrating a configuration of a refrigerator according to one embodiment of the present invention.

The above-described objects, features, and advantages will be described below in detail with reference to the attached drawings to allow one of ordinary skill in the art to easily execute the technical concept of the present invention. In the description of the embodiments of the present invention, a certain detailed explanation of a well-known function or component of the related art will be omitted when it is deemed to unnecessarily obscure the essence of the present invention. Hereinafter, exemplary embodiments of the present invention will be described in detail with reference to the attached drawings. Throughout the drawings, like reference numerals refer to like or similar elements.

FIG. 1 is a longitudinal cross-sectional view schematically illustrating a configuration of a refrigerator according to one embodiment of the present invention.

Referring to FIG. 1, in a body 106 of the refrigerator, a storage compartment with a vertical partition wall 118 therein, that is, a freezer compartment 102 and a refrigerator compartment 104, are formed. A freezer compartment door 108 and a refrigerator compartment door 110 are hinge-coupled to the body 106 at fronts of the freezer compartment 102 and the refrigerator compartment 104 to pivot and open and close the freezer compartment 102 and the refrigerator compartment 104, respectively.

The freezer compartment 102 includes a shelf 140 for dividing an inner space of the freezer compartment 102. The freezer compartment 102 shown in FIG. 1 is divided by the shelf 140 into a plurality of storage cells, that is, an upper cell 150 and a lower cell 152.

Likewise, the refrigerator compartment 104 includes shelves 142 and 144 for dividing an inner space of the refrigerator compartment 104. The refrigerator compartment 104 shown in FIG. 1 is divided by the shelves 142 and 144 into a plurality of storage cells, that is, an upper cell 154, a middle cell 156, and a lower cell 158.

Hereinafter, a configuration of the refrigerator according to one embodiment of the present invention will be described on the basis of the refrigerator compartment 104 being divided by the two shelves 142 and 144 into the three storage cells, that is, the upper cell 154, the middle cell 156, and the lower cell 158, as shown in FIG. 1. However, the number of the shelves 140, 142, 144 and the number of the storage cells 150, 152, 154, 156, and 158 divided by the shelves 140, 142, and 144 shown in FIG. 1 may vary according to an embodiment, and the present invention may be identically applied to a refrigerator including different numbers of shelves and storage cells.

A shroud member 112 is installed in a rear area of the freezer compartment 102 and spaced a certain distance apart from an inner wall of the body 106 to form an air flow path 126. Also, a multi-duct assembly 114 with cold air outlets 116 for allowing cold air to flow into the freezer compartment 102 may be installed at one side of the shroud member 112 and spaced apart therefrom.

Likewise, multi-duct assemblies 132 and 134 with cold air outlets 132*a*, 132*b*, and 132*c* for allowing cold air to flow into the refrigerator compartment 104 may be installed on a rear surface of the refrigerator compartment 104 and spaced apart therefrom. The multi-duct assemblies according to one embodiment of the present invention include a multi-duct panel 132 which includes the cold air outlets 132*a*, 132*b*, and 132*c* for allowing cold air to flow into the storage cells formed in the refrigerator compartment 104, that is, the upper cell 154, the middle cell 156, and the lower cell 158, respectively, and a variable duct panel 134 which is disposed on a rear surface of the multi-duct panel 132 and opens and closes the cold air outlets 132*a*, 132*b*, and 132*c* depending on an upward movement or a downward movement thereof.

Also, as shown in FIG. 1, a first internal temperature sensor 164, a second internal temperature sensor 166, and a third internal temperature sensor 168 for measuring internal temperatures of the upper cell 154, the middle cell 156, and the lower cell 158 are installed in the multi-duct panel 132. The position of the internal temperature sensors may vary depending on the embodiment.

A freezer compartment return flow path 120 for returning air in the freezer compartment 102 to the air flow path 126 is formed on one side area of the partition wall 118, and a refrigerator compartment return flow path 122 for returning air in the refrigerator compartment 104 to the air flow path 126 is formed on the other side area of the partition wall 118.

Meanwhile, an evaporator 124 for exchanging heat with air which flows into the air flow path 126 through the return flow paths 120 and 122 is provided in the air flow path 126 formed in the rear area of the freezer compartment 102. A storage compartment fan 128 for allowing the air which passes through the evaporator 124 to flow into the freezer compartment 102 or the refrigerator compartment 104 is installed above the evaporator 124.

A machine compartment is formed in a lower rear area of the body 106. A compressor 130 for compressing a refrigerant transferred thereto from the evaporator 124 is installed in the machine room, and a condenser (not shown) which condenses the refrigerant compressed by the compressor 130 through heat dissipation is provided on one side of the compressor 130.

According to the above-described configuration, the air in the freezer compartment 102 or the refrigerator compartment 104 flows into a bottom of the evaporator 124 through each of the return flow paths 120 and 122 according to rotation of the storage compartment fan 128. The air which flows into the bottom of the evaporator 124 is cooled by the refrigerant which flows through the evaporator 124 due to the compressor 130 being driven, and the cooled air is discharged through the cold air outlets 116, 132*a*, 132*b*, and 132*c* by the storage compartment fan 128 and flows into the freezer compartment 102 or the refrigerator compartment 104.

Meanwhile, although a top-mount type refrigerator in which the freezer compartment 102 is disposed above the refrigerator compartment 104 is shown in FIG. 1, the present invention is not limited thereto. That is, the present invention may be applied to a side-by-side type refrigerator in which a refrigerator compartment and a freezer compartment are disposed on left and right portions and a bottom-freezer type in which a refrigerator compartment is provided in an upper portion and a freezer compartment is provided in a lower portion.

Also, although the evaporator 124 is disposed only in the rear area of the freezer compartment 102 in FIG. 1, the evaporator may be disposed on the rear surface of the refrigerator compartment 104 in another embodiment of the present invention.

Figure 2:
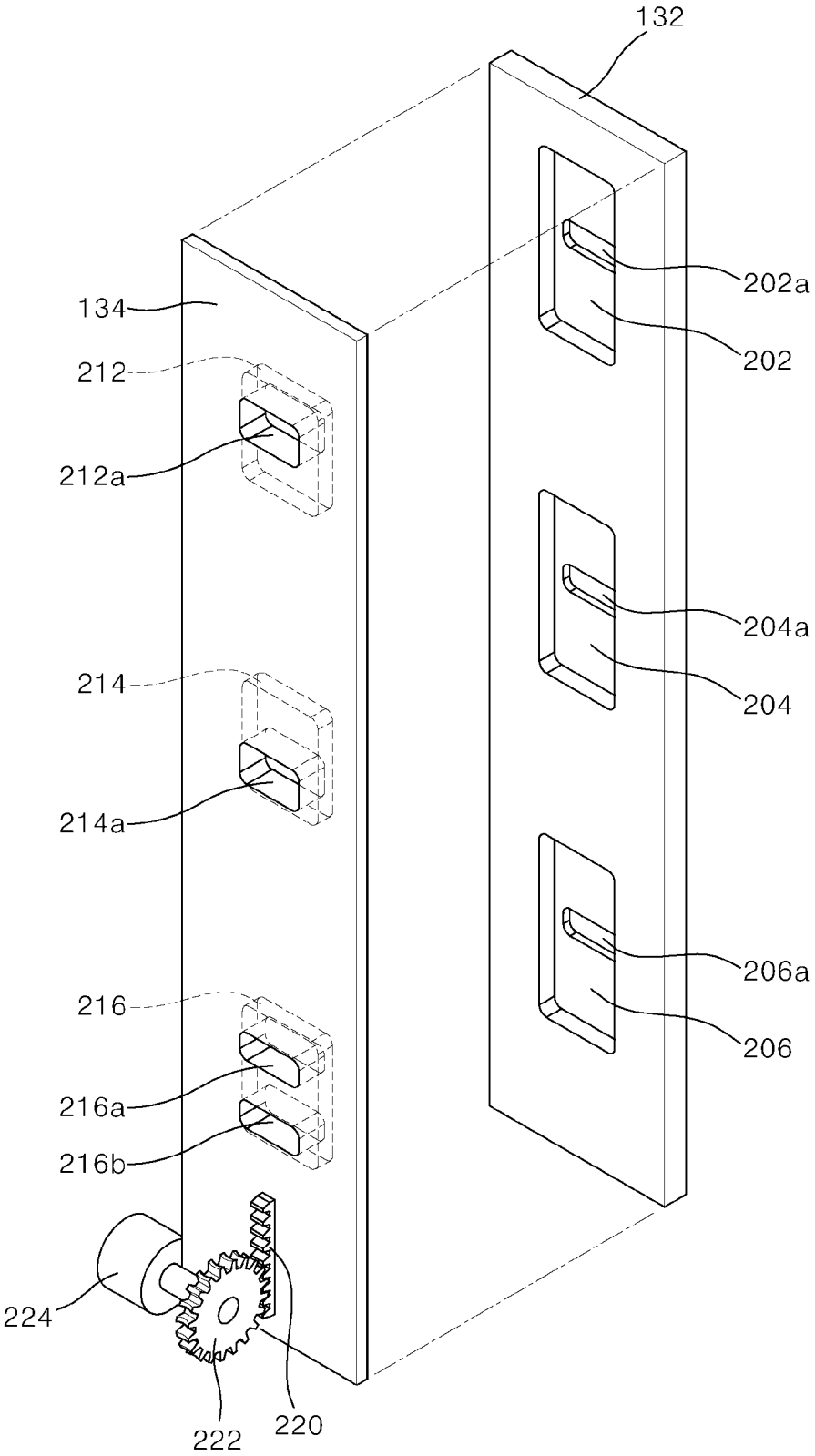
FIG. 2 is an exploded perspective view of a multi-duct assembly according to one embodiment of the present invention.
Figure 3:
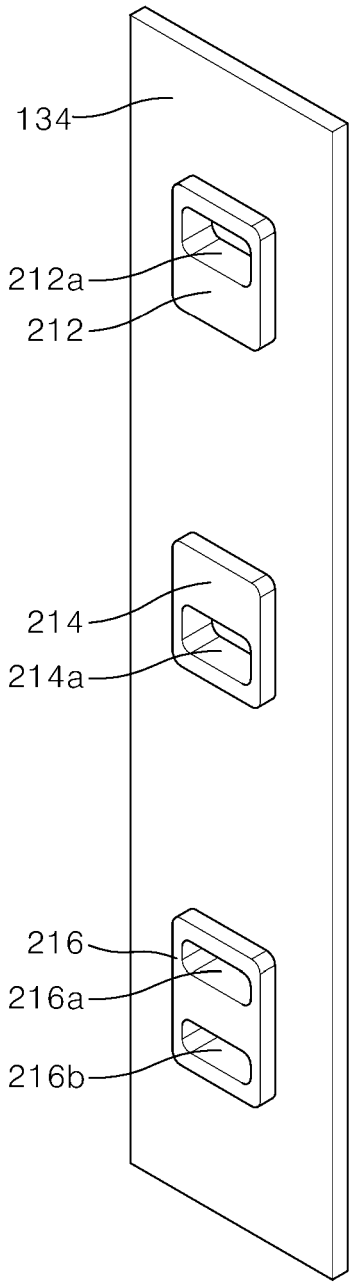
FIG. 3 is a perspective view of a variable duct panel included in the multi-duct assembly according to one embodiment of the present invention.

FIG. 2 is an exploded perspective view of a multi-duct assembly according to one embodiment of the present invention. Also, FIG. 3 is a perspective view of a variable duct panel included in the multi-duct assembly according to one embodiment of the present invention.

As shown in FIG. 2, the multi-duct assembly according to one embodiment of the present invention includes the multi-duct panel 132 and the variable duct panel 134.

The multi-duct panel 132 is disposed in the storage compartment, for example, on the rear surface of the refrigerator compartment 104. One or more cold air outlets 202*a*, 204*a*, and 206*a* for allowing the cold air cooled by the evaporator 124 to flow into the storage cells 154, 156, and 158 are formed in the multi-duct panel 132.

The cold air outlets 202*a*, 204*a*, and 206*a* formed in the multi-duct panel 132 are formed at positions corresponding to positions of the storage cells 154, 156, and 158 formed in the refrigerator compartment 104. In more detail, accommodation portions 202, 204, and 206 for accommodating protrusions 212, 214, and 216 of the variable duct panel 134, which will be described below, are formed at the multi-duct panel 132 to be recessed by a certain depth. Also, the cold air outlets 202*a*, 204*a*, and 206*a* are formed on one surfaces of the accommodation portions 202, 204, and 206, respectively.

The variable duct panel 134 is disposed on the rear surface of the multi-duct panel 132 and coupled to the multi-duct panel 132. The protrusions 212, 214, and 216 are formed on one surface of the variable duct panel 134 which faces the rear surface of the multi-duct panel 132 such that they may be accommodated in the accommodation portions 202, 204, and 206 formed at the multi-duct panel 132 when the variable duct panel 134 and the multi-duct panel 132 are coupled. Also, adjustable cold air openings 212*a*, 214*a*, 216*a*, and 216*b* for adjusting opening states and sizes of the cold air outlets 202*a*, 204*a*, and 206*a* are formed at one surfaces of the protrusions 212, 214, and 216.

Widths of the protrusions 212, 214, and 216 shown in FIG. 3 are formed to be smaller than or the same as widths of the accommodation portions 202, 204, and 206. Accordingly, when the variable duct panel 134 and the multi-duct panel 132 are coupled, the protrusions 212, 214, and 216 may be accommodated in the accommodation portions 202, 204, and 206.

Also, heights of the protrusions 212, 214, and 216 are formed to be smaller than heights of the accommodation portions 202, 204, and 206. Accordingly, when the variable duct panel 134 and the multi-duct panel 132 are coupled, the variable duct panel 134 moves upward or downward such that the protrusions 212, 214, and 216 accommodated in the accommodation portions 202, 204, and 206 may move upward or downward in the accommodation portions 202, 204, and 206. According to the above-described upward or downward movements of the protrusions 212, 214, and 216, the adjustable cold air openings 212*a*, 214*a*, 216*a*, and 216*b* formed at the protrusions 212, 214, and 216 move upward or downward. Also, according to the upward and downward movements of the adjustable cold air openings 212*a*, 214*a*, 216*a*, and 216*b*, the opening states and sizes of the cold air outlets 202*a*, 204*a*, and 206*a* may be adjusted.

In one embodiment of the present invention, sizes of the adjustable cold air openings 212*a*, 214*a*, 216*a*, and 216*b* shown in FIGS. 2 and 3 may be greater than or the same as the sizes of the cold air outlets 202*a*, 204*a*, and 206*a*. For example, as shown in FIGS. 2 and 3, an opening area of the first adjustable cold air opening 212*a* is larger than an opening area of the first cold air outlet 202*a*. Likewise, an opening area of the second adjustable cold air opening 214*a* is larger than an opening area of the second cold air outlet 204*a*. Meanwhile, opening areas of the third adjustable cold air opening 216*a* and the fourth adjustable cold air opening 216*b* are larger than or the same as an opening area of the third cold air outlet 206*a*.

Referring back to FIG. 2, driving units 222 and 224 for moving the variable duct panel 134 coupled with the multi-duct panel 132 upward or downward are coupled to the one surface of the variable duct panel 134. The driving units include a pinion gear 222 and a driving motor 224 which drives and rotates the pinion gear 222. A shelf gear 220 engaged with the pinion gear 222 is installed on the one surface of the variable duct panel 134. In an embodiment which will be described below, a controller (not shown) provided in the refrigerator according to one embodiment of the present invention may move the variable duct panel 134 upward or downward by driving the driving motor 224 according to a cooling mode selected by a user.

For example, although the shelf gear 220 and the pinion gear 222 are exemplarily shown in FIG. 2 as a structure for moving the variable duct panel 134 upward or downward, the variable duct panel 134 may be moved upward or downward by using another well-known structure in another embodiment of the present invention. Also, positions of the driving units 222 and 224 may vary according to an embodiment.

Hereinafter, a method of adjusting an opening state and a size of the first cold air outlet according to each embodiment of the present invention will be described in detail on the basis of the first cold air outlet 202*a* and the first adjustable cold air opening 212*a* among components shown in FIGS. 2 and 3.

Figure 4:
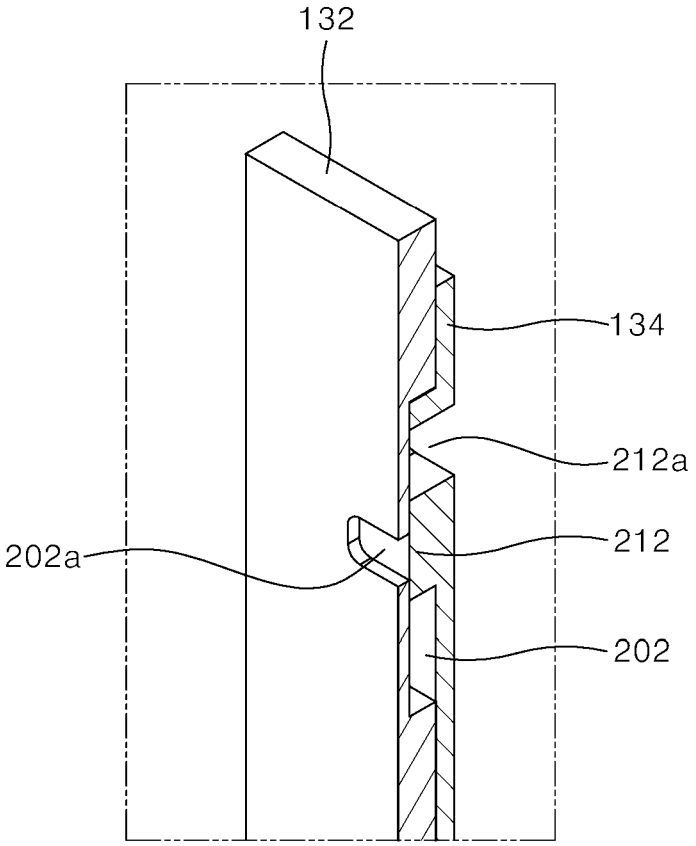
FIG. 4 is a perspective view of the multi-duct assembly in which a cold air outlet is completely closed.
Figure 5:
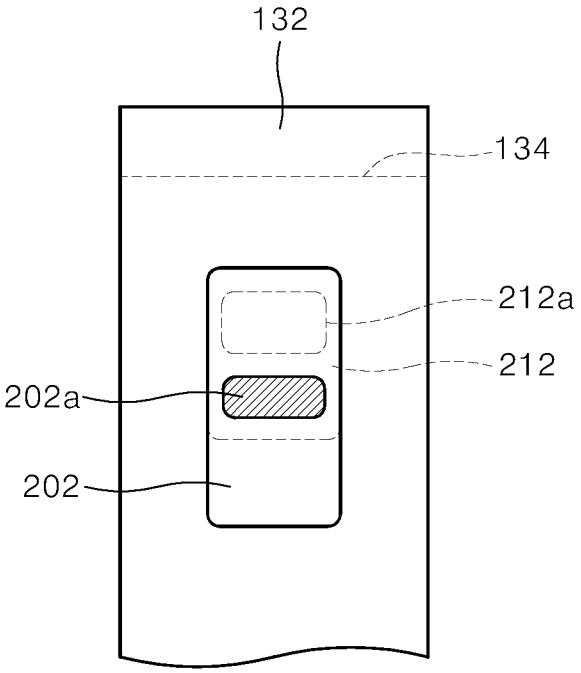
FIG. 5 is a front view of the multi-duct assembly in which the cold air outlet is completely closed.

FIG. 4 is a perspective view of the multi-duct assembly in which the cold air outlet is completely closed, and FIG. 5 is a front view of the multi-duct assembly in which the cold air outlet is completely closed.

As shown in FIGS. 4 and 5, the multi-duct panel 132 is coupled with the variable duct panel 134 disposed on the rear surface thereof. In this case, as described above, the protrusion 212 of the variable duct panel 134 is accommodated in the accommodation portion 202 of the variable duct panel 134.

When the variable duct panel 134 moves upward while the protrusion 212 is accommodated in the accommodation portion 202, the adjustable cold air opening 212*a* formed at the one surface of the protrusion 212 also moves upward, as shown in FIGS. 4 and 5. Accordingly, as shown in FIGS. 4 and 5, the adjustable cold air opening 212*a* is positioned above the cold air outlet 202*a* such that the adjustable cold air opening 212*a* and the cold air outlet 202*a* are not connected.

As described above, when the adjustable cold air opening 212*a* and the cold air outlet 202*a* are disposed so as not to be connected, the cold air outlet 202*a* is closed by the protrusion 212. The cold air outlet 202*a* is closed such that an inflow of cold air into the upper cell 154 is cut off.

Figure 6:
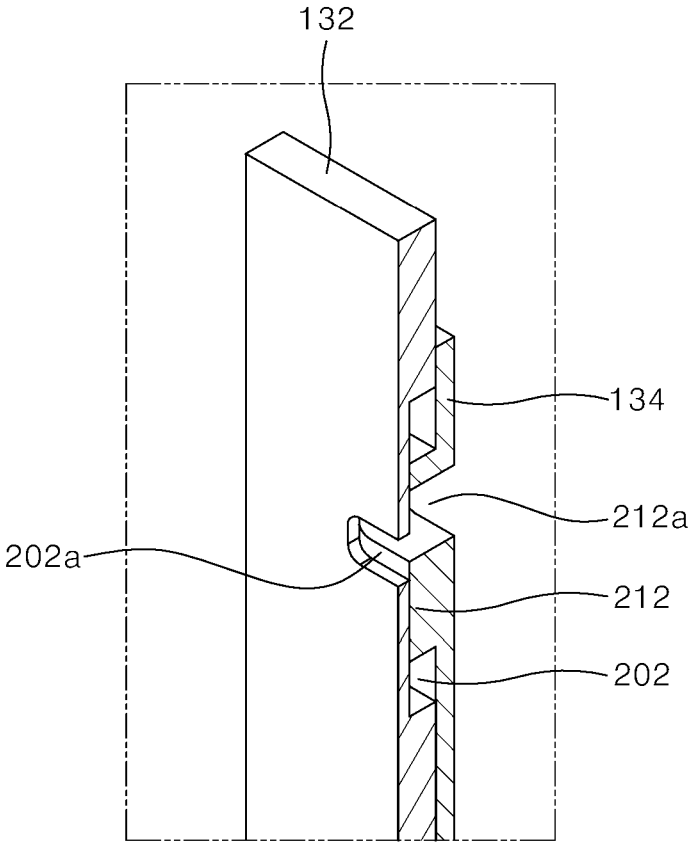
FIG. 6 is a perspective view of the multi-duct assembly in which the cold air outlet is partially opened.
Figure 7:
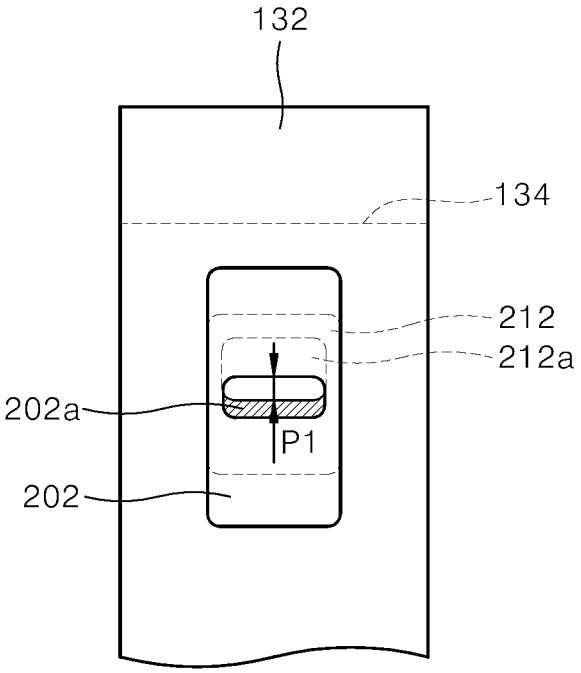
FIG. 7 is a front view of the multi-duct assembly in which the cold air outlet is partially opened.

FIG. 6 is a perspective view of the multi-duct assembly in which the cold air outlet is partially opened, and FIG. 7 is a front view of the multi-duct assembly in which the cold air outlet is partially opened;

As shown in FIGS. 6 and 7, when the variable duct panel 134 coupled with the multi-duct panel 132 moves a certain distance downward, the protrusion 212 and the adjustable cold air opening 212*a* formed at the one surface of the protrusion 212 also move downward. Accordingly, a partial area of the adjustable cold air opening 212*a* overlaps with a partial area of the cold air outlet 202*a*, and the adjustable cold air opening 212*a* and the cold air outlet 202*a* are connected by as much as the overlapped area.

As described above, in one embodiment of the present invention, the opening area of the cold air outlet 202*a* may be adjusted by adjusting a height P1 of the overlapped area between the adjustable cold air opening 212*a* and the cold air outlet 202*a*. The above-described opening area of the cold air outlet 202*a* is proportional to an amount of cold air which flows into the upper cell 154 through the cold air outlet 202*a*. Therefore, according to one embodiment of the present invention, an advantage in that an amount of cold air which flows into a storage compartment may be adjusted by adjusting the opening area of the cold air outlet 202*a* may be provided.

Figure 8:
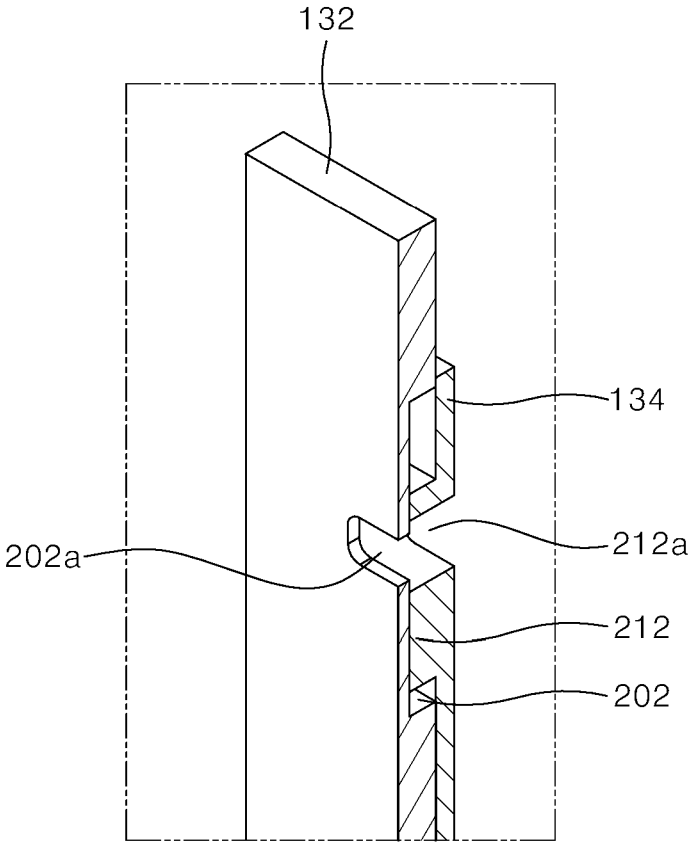
FIG. 8 is a perspective view of the multi-duct assembly in which the cold air outlet is completely opened.
Figure 9:
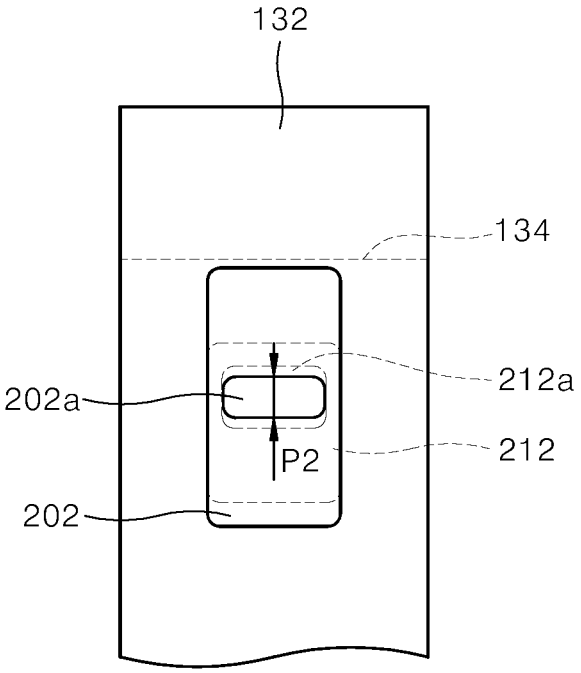
FIG. 9 is a front view of the multi-duct assembly in which the cold air outlet is completely opened.

FIG. 8 is a perspective view of the multi-duct assembly in which the cold air outlet is completely opened, and FIG. 9 is a front view of the multi-duct assembly in which the cold air outlet is completely opened.

As shown in FIGS. 8 and 9, when the variable duct panel 134 coupled with the multi-duct panel 132 further moves a certain distance downward, the protrusion 212 and the adjustable cold air opening 212*a* formed at the one surface of the protrusion 212 also move downward. Accordingly, the entire cold air outlet 202*a* overlaps the adjustable cold air opening 212*a*. Accordingly, the entire opening area of the cold air outlet 202*a* is in communication with the adjustable cold air opening 212*a*. Accordingly, the cold air outlet 202*a* is completely opened. Here, a height P2 of the overlapped area between the adjustable cold air opening 212*a* and the cold air outlet 202*a* is maximized.

Meanwhile, as shown in FIGS. 4 to 9, corners of at least one of the cold air outlet 202*a* and the adjustable cold air opening 212*a* may be formed of curves with a predetermined curvature. Here, the curvature of each of the corners may be set to be different according to an embodiment. Since a final shape of the cold air outlet 202*a* formed by the adjustable cold air opening 212*a* and the cold air outlet 202*a* is exposed outward through an inside of the refrigerator compartment 104, a user may observe the final shape by naked eye during a process of using the refrigerator. Accordingly, the corners of the cold air outlet 202*a* or the adjustable cold air opening 212*a* have a curved shape such that an effect of allowing the user to be aesthetically pleased is provided.

Hereinafter, referring to FIGS. 10 to 13, adjustment of an opening and closing state of the cold air outlet according to upward or downward movement of the variable duct panel 134 will be described in detail.

Figure 10:
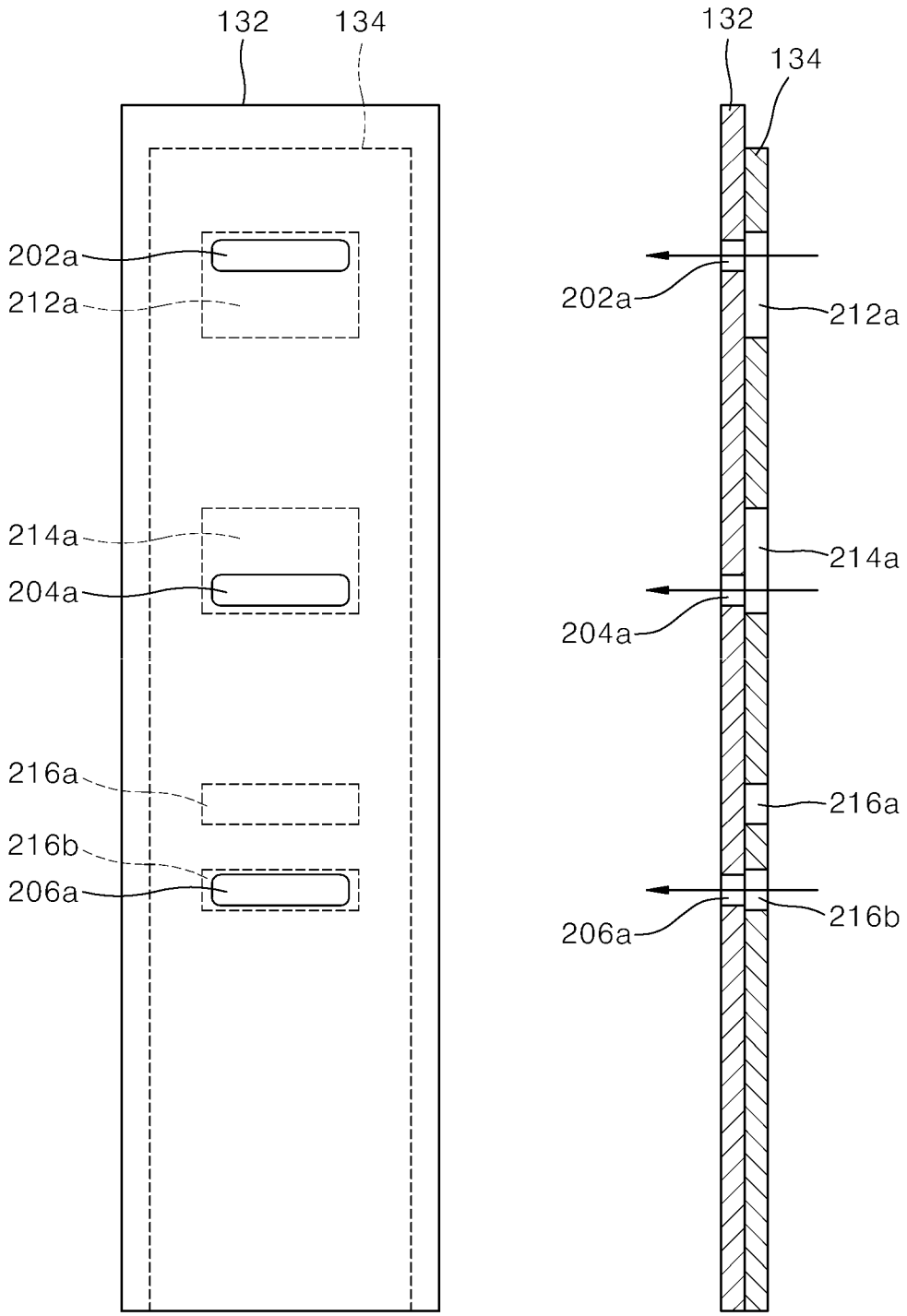
FIG. 10 illustrates a front view and a side view of the multi-duct assembly in which all cold air outlets are opened according to one embodiment of the present invention.

FIG. 10 illustrates a front view and a side view of the multi-duct assembly in which all cold air outlets are opened according to one embodiment of the present invention.

In the embodiment shown in FIG. 10, all of the first cold air outlet 202*a*, the second cold air outlet 204*a*, and the third cold air outlet 206*a* in the multi-duct panel 132 are opened. Accordingly, cold air may flow into the upper cell 154, the middle cell 156, and the lower cell 158 through the first cold air outlet 202*a*, the second cold air outlet 204*a*, and the third cold air outlet 206*a*.

In FIG. 10, a position of the variable duct panel 134 for an inflow through all of the cold air outlets in the multi-duct panel 132 is illustrated. When the variable duct panel 134 moves upward, as shown in FIG. 10, the first cold air outlet 202*a* and the first adjustable cold air opening 212*a* are brought into communication with each other. Likewise, the second cold air outlet 204*a* is brought into communication with the second adjustable cold air opening 214*a*, and the third cold air outlet 206*a* is brought into communication with the fourth adjustable cold air opening 216*b*.

For example, when a situation in which all of the storage cells need to be cooled in an automatic cooling mode, which will be described below, occurs or the refrigerator operates in a general cooling mode, all of the cold air outlets may be opened as shown in FIG. 10.

Figure 11:
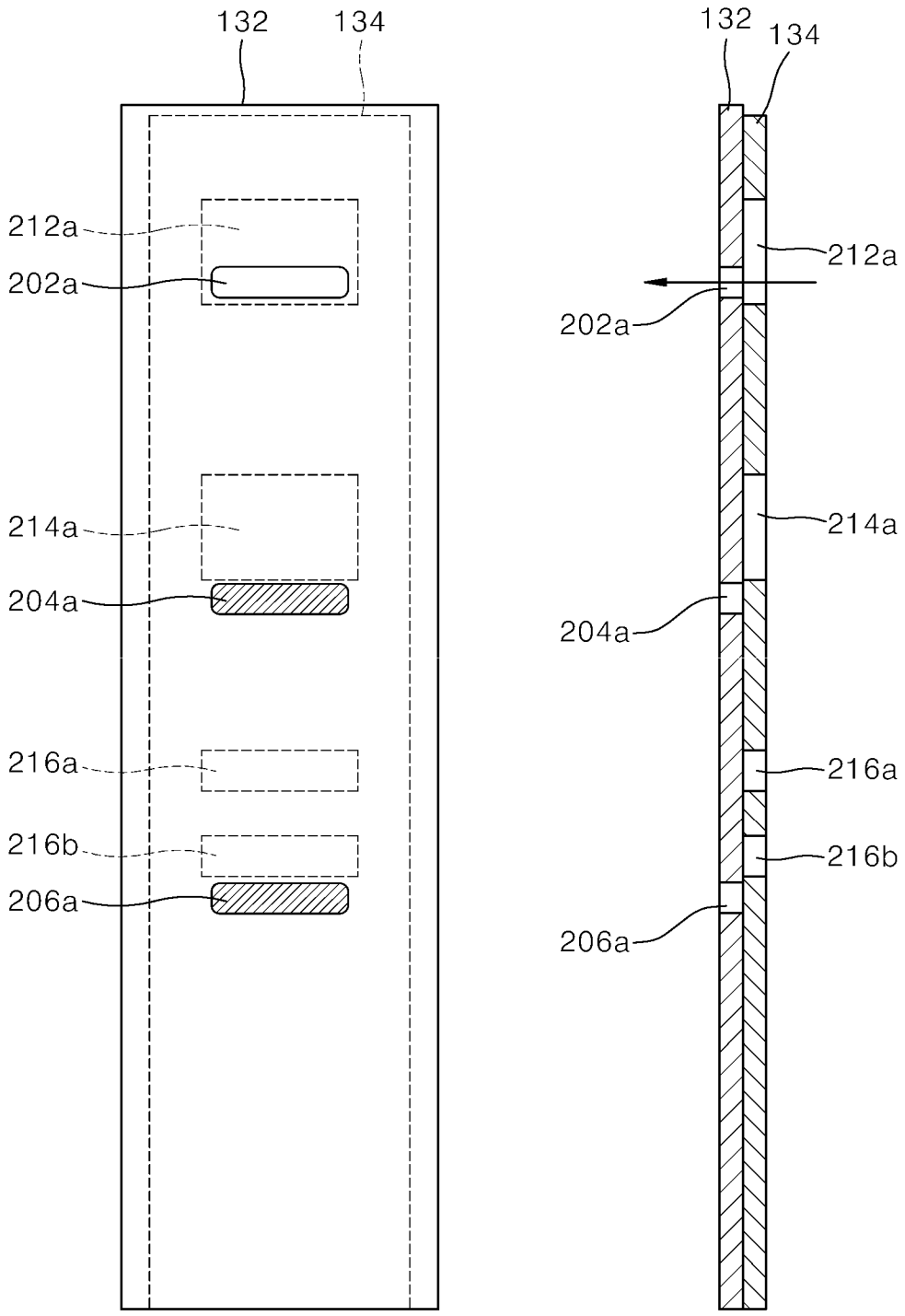
FIG. 11 illustrates a front view and a side view of the multi-duct assembly in which a cold air outlet corresponding to an upper cell is opened according to one embodiment of the present invention.

FIG. 11 illustrates a front view and a side view of the multi-duct assembly in which a cold air outlet corresponding to the upper cell is opened according to one embodiment of the present invention.

FIG. 11 illustrates an opening state of the cold air outlet according to movement of the variable duct panel 134 when it is necessary to cool only the upper cell 154 in an intensive cooling mode or the automatic cooling mode, which will be described below, in other words, when the upper cell 154 is determined to be a storage cell which is an object of cooling.

When the variable duct panel 134 moves upward while all the cold air outlets are open, as shown in FIG. 10, the second cold air outlet 204*a* and the third cold air outlet 206*a* are cut off by the variable duct panel 134, are not connected to the adjustable cold air openings, and are closed as shown in FIG. 11. However, since the first cold air outlet 202*a* remains in a state of communicating with the first adjustable cold air opening 212*a*, only the first cold air outlet 202*a* may be open.

Figure 12:
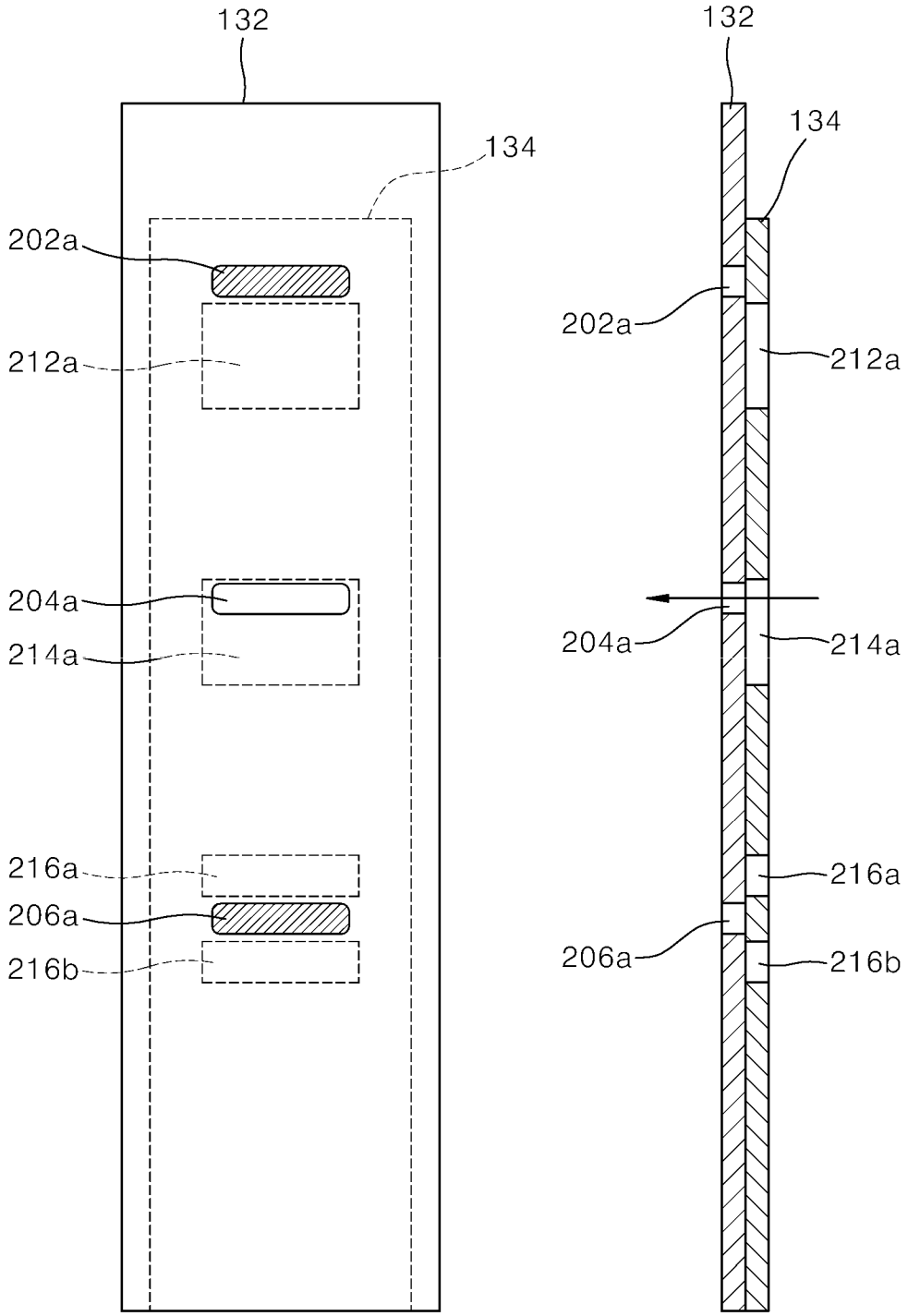
FIG. 12 illustrates a front view and a side view of the multi-duct assembly in which a cold air outlet corresponding to a middle cell is opened according to one embodiment of the present invention.

FIG. 12 illustrates a front view and a side view of the multi-duct assembly in which a cold air outlet corresponding to the middle cell is opened according to one embodiment of the present invention.

FIG. 12 illustrates an opening state of the cold air outlet according to movement of the variable duct panel 134 when it is necessary to cool only the middle cell 156 in the intensive cooling mode or the automatic cooling mode, in other words, when the middle cell 156 is determined to be the storage cell which is an object of cooling.

When the variable duct panel 134 moves downward while all of the cold air outlets are open, as shown in FIG. 10, the first cold air outlet 202*a* and the third cold air outlet 206*a* are cut off by the variable duct panel 134, are not connected to the adjustable cold air openings, and are closed as shown in FIG. 12. However, since the second cold air outlet 204*a* remains in a state communicating with the second adjustable cold air opening 214*a*, only the second cold air outlet 204*a* may be open.

Figure 13:
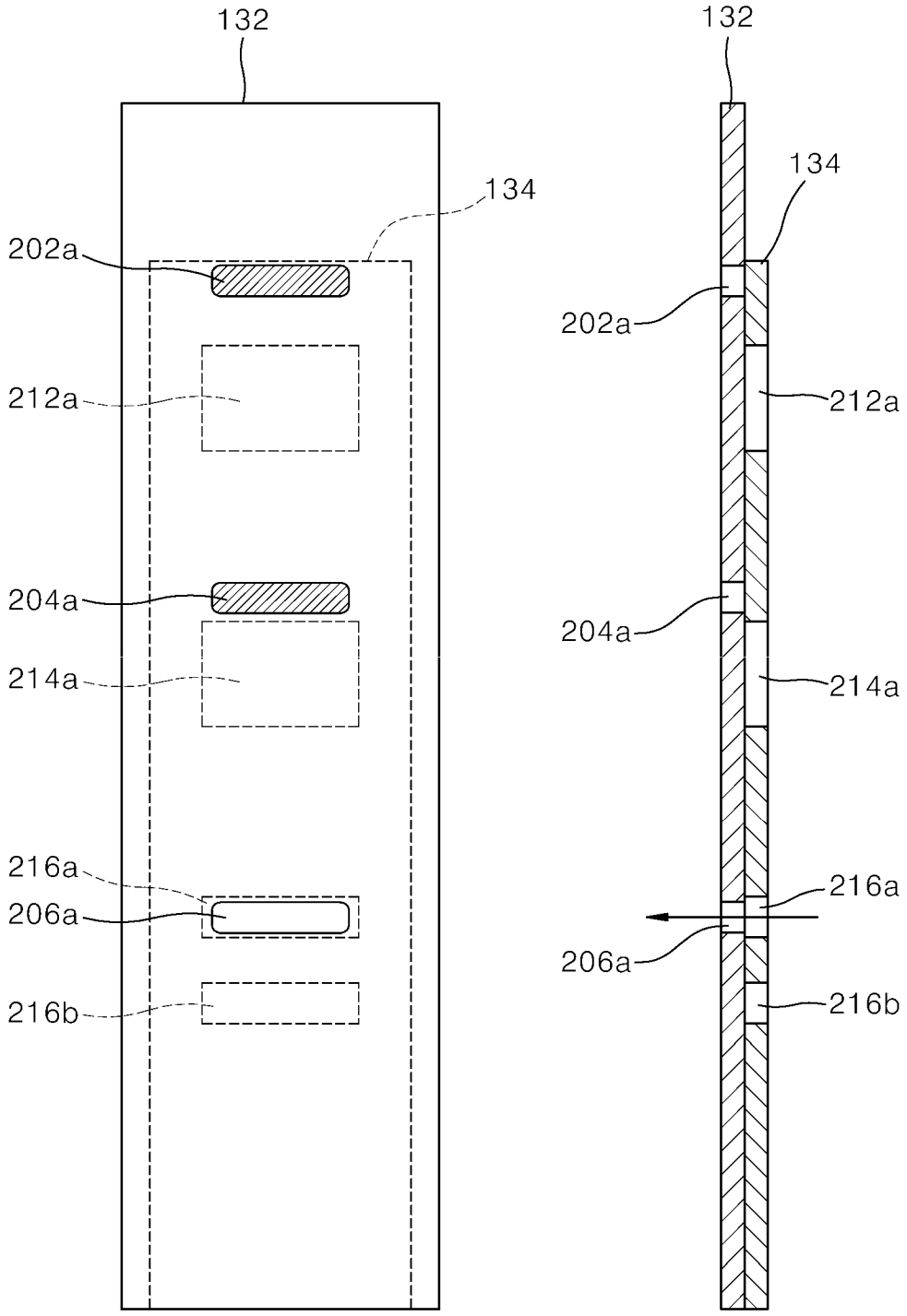
FIG. 13 illustrates a front view and a side view of the multi-duct assembly in which a cold air outlet corresponding to a lower cell is opened according to one embodiment of the present invention.

FIG. 13 illustrates a front view and a side view of the multi-duct assembly in which a cold air outlet corresponding to the lower cell is opened according to one embodiment of the present invention.

FIG. 13 illustrates an opening state of the cold air outlet according to movement of the variable duct panel 134 when it is necessary to cool only the lower cell 158 in the intensive cooling mode or the automatic cooling mode, in other words, when the lower cell 158 is determined to be the storage cell which is an object of cooling.

When the variable duct panel 134 moves downward while all of the cold air outlets are open, as shown in FIG. 10, the first cold air outlet 202*a* and the second cold air outlet 204*a* are cut off by the variable duct panel 134, are not connected to the adjustable cold air openings, and are closed as shown in FIG. 13. However, since the third cold air outlet 206*a* remains in a state of communicating with the third adjustable cold air opening 216*a*, only the third cold air outlet 206*a* may be open.

Hereinafter, a process of controlling a cooling operation of a refrigerator according to a selection of the user for the cooling mode will be described in detail.

Figure 14:
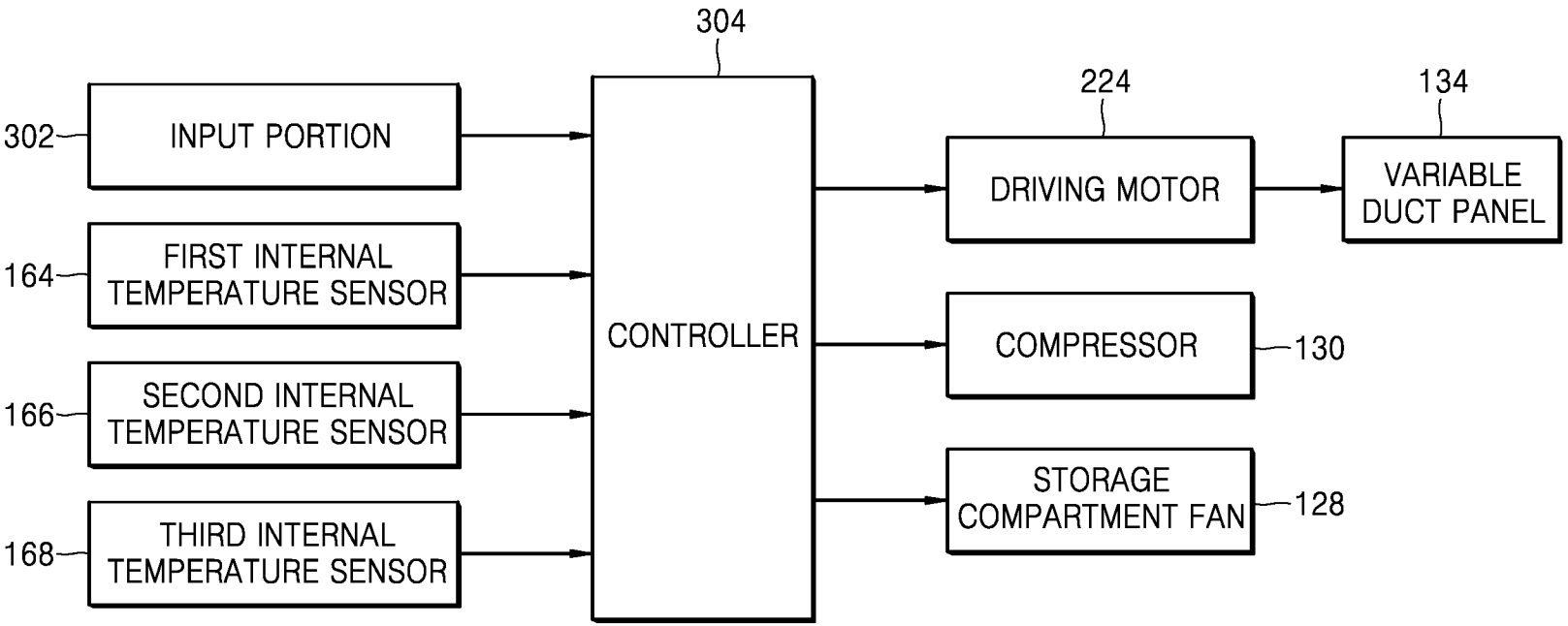
FIG. 14 is a configuration diagram illustrating a controller and peripheral modules of the refrigerator according to one embodiment of the present invention.

FIG. 14 is a configuration diagram illustrating a controller and peripheral modules according to one embodiment of the present invention.

Referring to FIG. 14, a controller 304 receives a cooling mode with respect to a storage compartment of the refrigerator through an input portion 302. In one embodiment of the present invention, the refrigerator may be driven in a general mode, the intensive cooling mode, and the automatic cooling mode, and the user may input any one mode among them through the input portion 302. Also, when the intensive cooling mode is selected, the user may select a storage cell to be cooled as an object of intensive cooling through the input portion 302.

When the user inputs a cooling mode through the input portion 302, the controller 304 determines a storage cell which is an object of cooling among the storage cells according to the input cooling mode. When the cooling mode input by the user is the intensive cooling mode, the controller 304 may determine that a storage cell selected by the user to be a storage cell which is an object of intensive cooling is the storage cell which is the object of cooling.

For example, when the user selects the intensive cooling mode through the input portion 302 and selects the middle cell 156 as the object of intensive cooling, the controller 304 determines the middle cell 156 to be the storage cell which is the object of cooling. A process of selecting the cooling mode and the object of the intensive cooling through the input portion 302 will be described in detail with reference to FIGS. 15 to 19.

Also, when the cooling mode input by the user is the automatic cooling mode, the controller 304 may measure internal temperatures of the upper cell 154, the middle cell 156, and the lower cell 158 through the first internal temperature sensor 164, the second internal temperature sensor 166, and the third internal temperature sensor 168. The controller 304 compares the measured internal temperatures of the upper cell 154, the middle cell 156, and the lower cell 158 with a preset second reference temperature and checks the number of storage cells having an internal temperature which exceeds the second reference temperature.

When the number of storage cells having an internal temperature which exceeds the second reference temperature is determined to be lower than a preset reference number as a result of the checking, the controller 304 determines a storage cell having an internal temperature which exceeds the preset second reference temperature to be the storage cell which is the object of cooling. For example, when the reference number is two and the number of storage cells having an internal temperature which exceeds the second reference temperature is determined to be one, which is the upper cell 154, the controller 304 determines only the upper cell 154 to be the storage cell which is the object of cooling.

However, when it is determined that the number of storage cells having an internal temperature which exceeds the second reference temperature is the preset reference number or more, the controller 304 determines all of the storage cells to be storage cells which are objects of cooling. For example, when the reference number is two and the number of storage cells having an internal temperature which exceeds the second reference temperature is determined to be two or three, the controller 304 determines all of the upper cell 154, the middle cell 156, and the lower cell 158 to be the storage cells which are the objects of cooling. Here, the reference number may be set to be different according to the number of storage cells.

When the storage cell which is the object of cooling is determined through the above-described process, the controller 304 moves the variable duct panel 134 by driving the driving motor 224 to rotate to open the cold air outlet corresponding to the storage cell which is the object of cooling. For example, when only the middle cell 156 or the upper cell 154 is determined to be the storage cell which is the object of cooling, as described above, the controller 304 selectively opens only the cold air outlet corresponding to the middle cell 156 or the upper cell 154 by moving the variable duct panel 134 as shown in FIG. 12 or 11.

However, when the number of storage cells having an internal temperature which exceeds the second reference temperature is determined to be two or three and all of the storage cells are determined to be the storage cells which are the objects of cooling, the controller 304 opens the cold air outlets corresponding to all of the storage cells by moving the variable duct panel 134 as shown in FIG. 10.

When the cold air outlet is opened by the above-described process, the controller 304 drives the compressor 130 and the storage compartment fan 128 to generate cold air through the cooling operation. Accordingly, the compressor 130 is driven, and air cooled by the refrigerant which flows through the evaporator 124 is moved toward the cold air outlet by the storage compartment fan 128 being driven. Here, since only the cold air outlet corresponding to the storage cell which is the object of cooling is open, as described above, cold air is introduced into only the storage cell which is the object of cooling through the open cold air outlet. Accordingly, the cooling operation is performed on the storage cell which is the object of cooling, and the cold air does not flow into the other storage cells.

The controller 304 performs the cooling operation and checks the internal temperature of the storage cell with the open cold air outlet, that is, the storage cell which is the object of cooling, through the internal temperature sensor disposed at the storage cell which is the object of cooling. Also, the controller 304 checks driving times of the compressor 130 and the storage compartment fan 128 after starting to drive the compressor 130 and the storage compartment fan 128.

When the internal temperature of the storage cell which is the object of cooling is a preset first reference temperature or lower or the driving times of the compressor 130 and the storage compartment fan 128 reach a reference driving time, the controller 304 determines that cooling of the storage cell which is the object of cooling is completed and stops the cooling thereof.

Here, the controller 304 may stop the cooling of the storage cell which is the object of cooling by moving the variable duct panel 134 to close the cold air outlet corresponding to the storage cell which is the object of cooling. Also, in another embodiment of the present invention, the controller 304 may stop the cooling of the storage cell which is the object of cooling by stopping the driving of the compressor 130 and the storage compartment fan 128.

However, when the internal temperature of the storage cell which is the object of cooling is higher than the preset first reference temperature or the driving times of the compressor 130 and the storage compartment fan 128 do not reach the reference driving time, the controller 304 continuously performs the cooling operation of the storage cell which is the object of cooling.

Hereinafter, referring to FIGS. 15 to 19, a process of selecting a cooling mode and an object of cooling through the input portion according to one embodiment of the present invention will be described.

Figure 15:
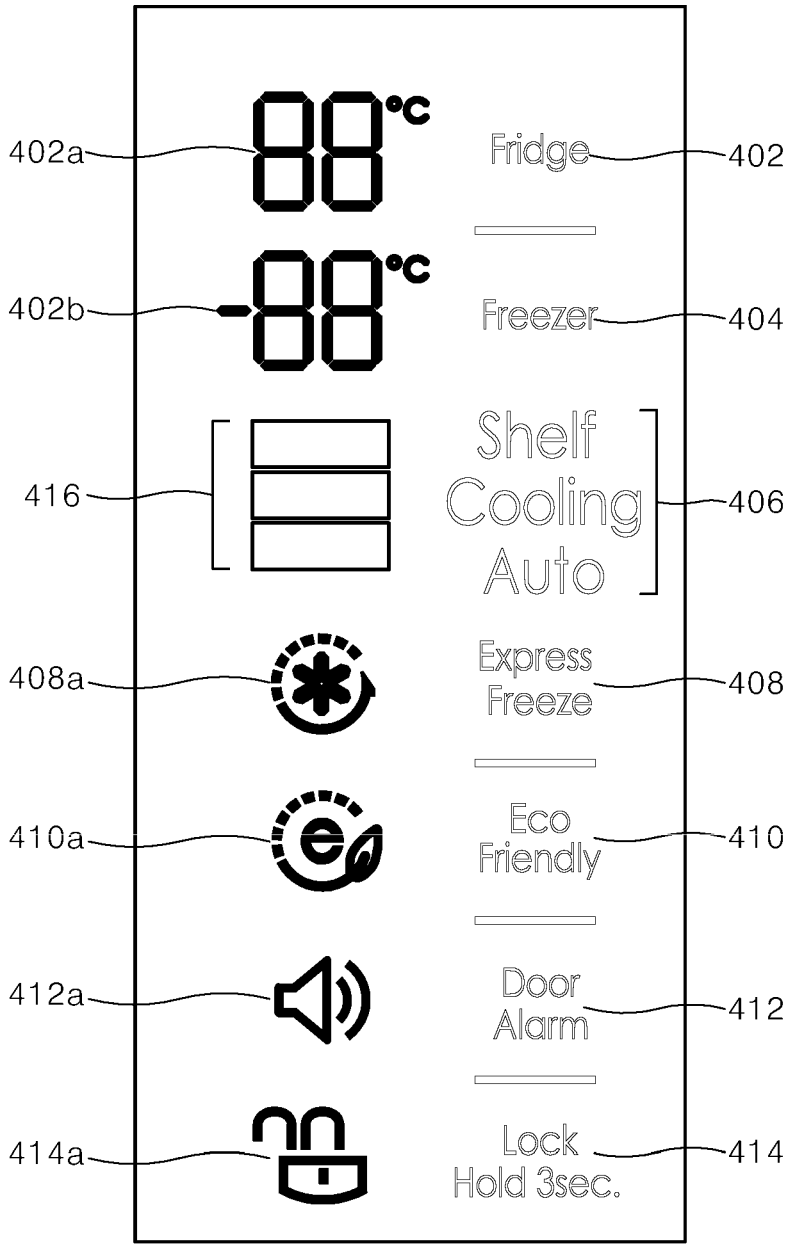
FIG. 15 is a configuration diagram illustrating an input portion and a display portion when the refrigerator according to one embodiment of the present invention operates in a general mode.

FIG. 15 is a configuration diagram illustrating the input portion and a display portion when the refrigerator according to one embodiment of the present invention operates in a general mode.

In FIG. 15, the input portion and the display portion included on one side of the refrigerator according to one embodiment of the present invention are shown. The input portion and the display portion according to one embodiment of the present invention may be embodied as an integrated touch panel, as shown in FIGS. 15 to 19. However, the input portion according to one embodiment of the present invention may be embodied in various forms such as a physical button, a lever, and the like, unlike the example shown in FIGS. 15 to 19.

Referring to FIG. 15, each of a refrigerator compartment temperature 402*a* and a freezer compartment temperature 402*b* is displayed on the display portion, and a user may adjust the refrigerator compartment temperature or the freezer compartment temperature as desired by touching each of a refrigerator compartment temperature adjustment button 402 and a freezer compartment temperature adjustment button 404 disposed on the input portion. The refrigerator compartment temperature or the freezer compartment temperature may be set to be increased or decreased by a certain level according to the number of touches of the refrigerator compartment temperature adjustment button 402 or the freezer compartment temperature adjustment button 404 by the user.

Also, an intensive cooling shelf icon 416 is displayed on the display portion, as shown in FIG. 15, and the user may select a cooling mode and an object of intensive cooling of the refrigerator by touching a mode and shelf selection button 406. In one embodiment of the present invention, the cooling mode and the object of intensive cooling may vary according to the number of touches of the mode and shelf selection button 406 by the user.

Also, a high-speed cooling button 408 is disposed on the input portion, and a high-speed cooling icon 408*a* of the display portion is turned on or off depending on whether the user touches the high-speed cooling button 408. When the high-speed cooling icon 408*a* is turned on, the refrigerator operates in a high-speed cooling mode. In this case, all of the cold air outlets may be opened, as shown in FIG. 10.

Also, a power-saving mode button 410 is disposed on the input portion, and a power-saving mode icon 410*a* of the display portion is turned on or off depending on whether the user touches the power-saving mode button 410. In one embodiment of the present invention, when the user touches the power-saving mode button 410 and the power-saving mode icon 410*a* is turned on, the refrigerator operates in a power-saving mode. When a power-saving operation is selected, an opening area of a cold air outlet may be adjusted corresponding to an amount of cold air for power saving (for example, 50% of the general mode), as described above with reference to FIGS. 6 and 7, when a cold air outlet corresponding to a storage cell which is the object of cooling is opened to operate in the intensive cooling mode or the automatic cooling mode.

Also, a door-alarm mode button 412 is disposed on the input portion, and a door-alarm icon 412*a* of the display portion is turned on or off depending on whether the user touches the door-alarm mode button 412. When the door-alarm icon 412*a* is turned on, an alarm may be transferred to the user when the doors of the refrigerator remain in an open state for a certain time or more.

Also, a locking button 414 is disposed on the input portion, and a locking icon 414*a* of the display portion is turned on or off depending on whether the user touches the locking button 414. When the user touches the locking button 414 for a certain time or more such that the locking icon 414*a* is turned on, driving of the other buttons 402, 404, 406, 408, 410, and 412 is deactivated. Afterward, when the user touches the locking button 414 for a certain time or more such that the locking icon 414*a* is turned off, the driving of the other buttons 402, 404, 406, 408, 410, and 412 is reactivated.

In FIG. 15, states of the input portion and the display portion when the user foes not touch the mode and shelf selection button 406 are shown. When the user does not touch the mode and shelf selection button 406, both the intensive cooling shelf icon 416 and the mode and shelf selection button 406 remain in an off state. This means that the refrigerator operates in the general mode and not in the intensive cooling mode or the automatic cooling mode.

Figure 16:
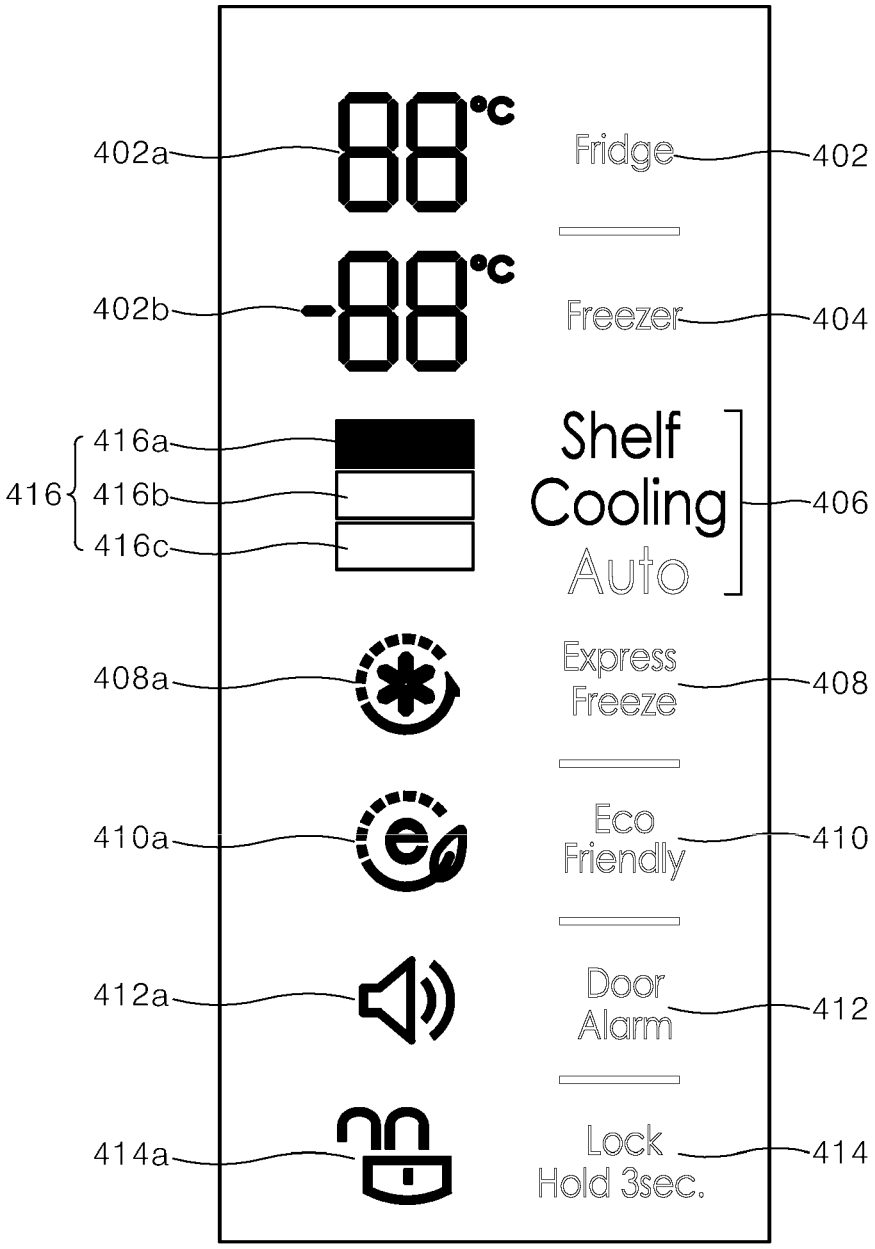
FIG. 16 is a configuration diagram illustrating the input portion and the display portion when a user selects an intensive cooling mode for the upper cell according to one embodiment of the present invention.

FIG. 16 is a configuration diagram illustrating the input portion and the display portion when the user selects the intensive cooling mode for the upper cell according to one embodiment of the present invention.

When the user touches the mode and shelf selection button 406 one time in the state shown in FIG. 15, some areas of the mode and shelf selection button 406, for example, areas of "shelf" and "cooling," are turned on, as shown in FIG. 16. The turning-on of the areas of "shelf" and "cooling" refers to the intensive cooling mode being selected by the input portion. Also, an upper cell icon 416*a* of the intensive cooling shelf icon 416 is turned on at the same time as the turning-on of the areas of "shelf" and "cooling" caused by the selection of the intensive cooling mode. This action refers to the upper cell being selected as the object of intensive cooling.

That is, when the user touches the mode and shelf selection button 406 one time while the refrigerator operates in the general mode, as shown in FIG. 15, the refrigerator operates in the intensive cooling mode with respect to the upper cell. Accordingly, the controller 304 sets the upper cell to be the storage cell which is the object of cooling and performs the cooling operation with respect to the upper cell by opening the cold air outlet corresponding to the upper cell.

Figure 17:
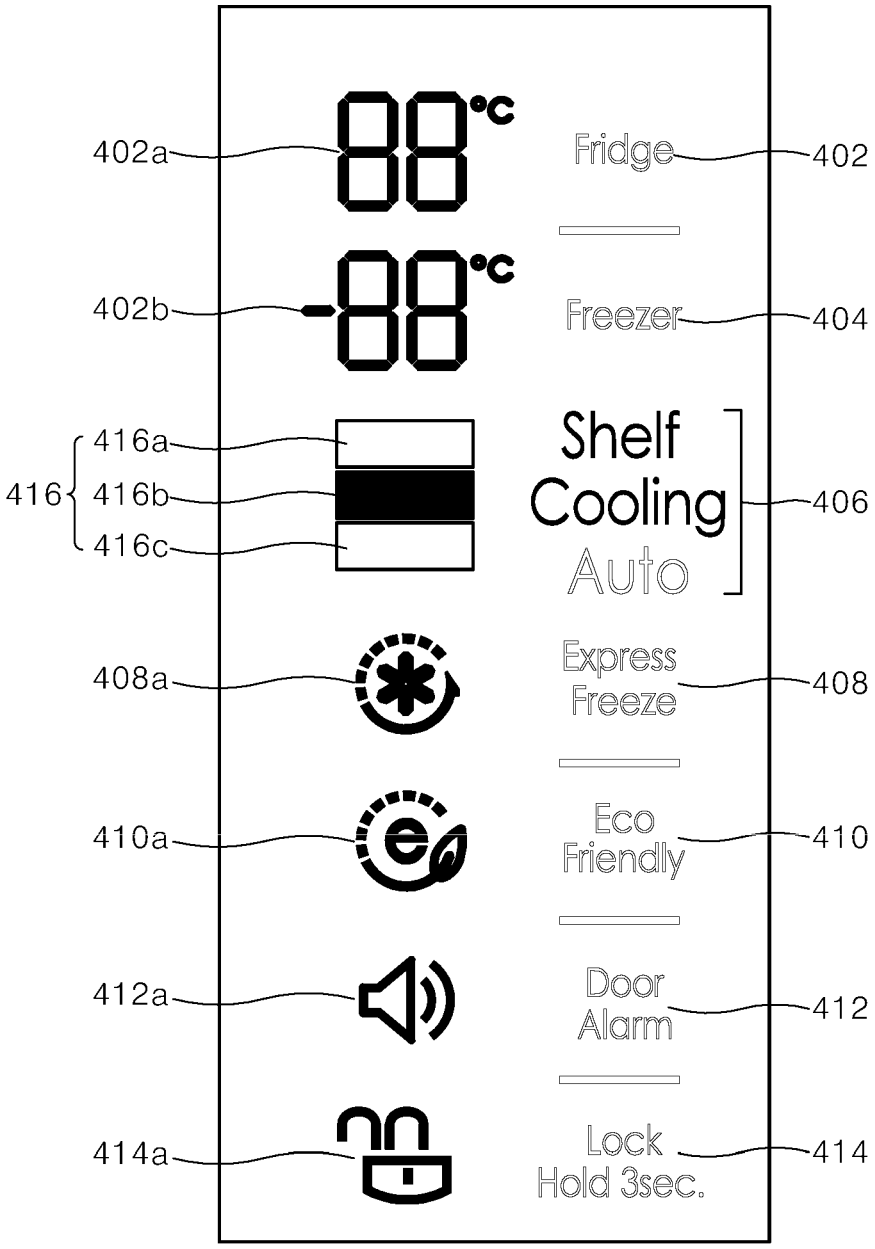
FIG. 17 is a configuration diagram illustrating the input portion and the display portion when the user selects the intensive cooling mode for the middle cell according to one embodiment of the present invention.

FIG. 17 is a configuration diagram illustrating the input portion and the display portion when the user selects the intensive cooling mode for the middle cell according to one embodiment of the present invention.

When the user touches the mode and shelf selection button 406 one time, as shown in FIG. 16, and touches the mode and shelf selection button 406 again, the areas of "shelf" and "cooling" remain in a turned-on state and a middle cell icon 416*b* of the intensive cooling shelf icons 416 is turned on, as shown in FIG. 17. This means that the refrigerator operates in the intensive cooling mode and the middle cell is selected as the object of intensive cooling.

That is, when the user touches the mode and shelf selection button 406 two times while the refrigerator operates in the general mode, as shown in FIG. 15, the refrigerator operates in the intensive cooling mode with respect to the middle cell. Accordingly, the controller 304 sets the middle cell to be the storage cell which is the object of cooling and performs the cooling operation with respect to the middle cell by opening the cold air outlet corresponding to the middle cell.

Figure 18:
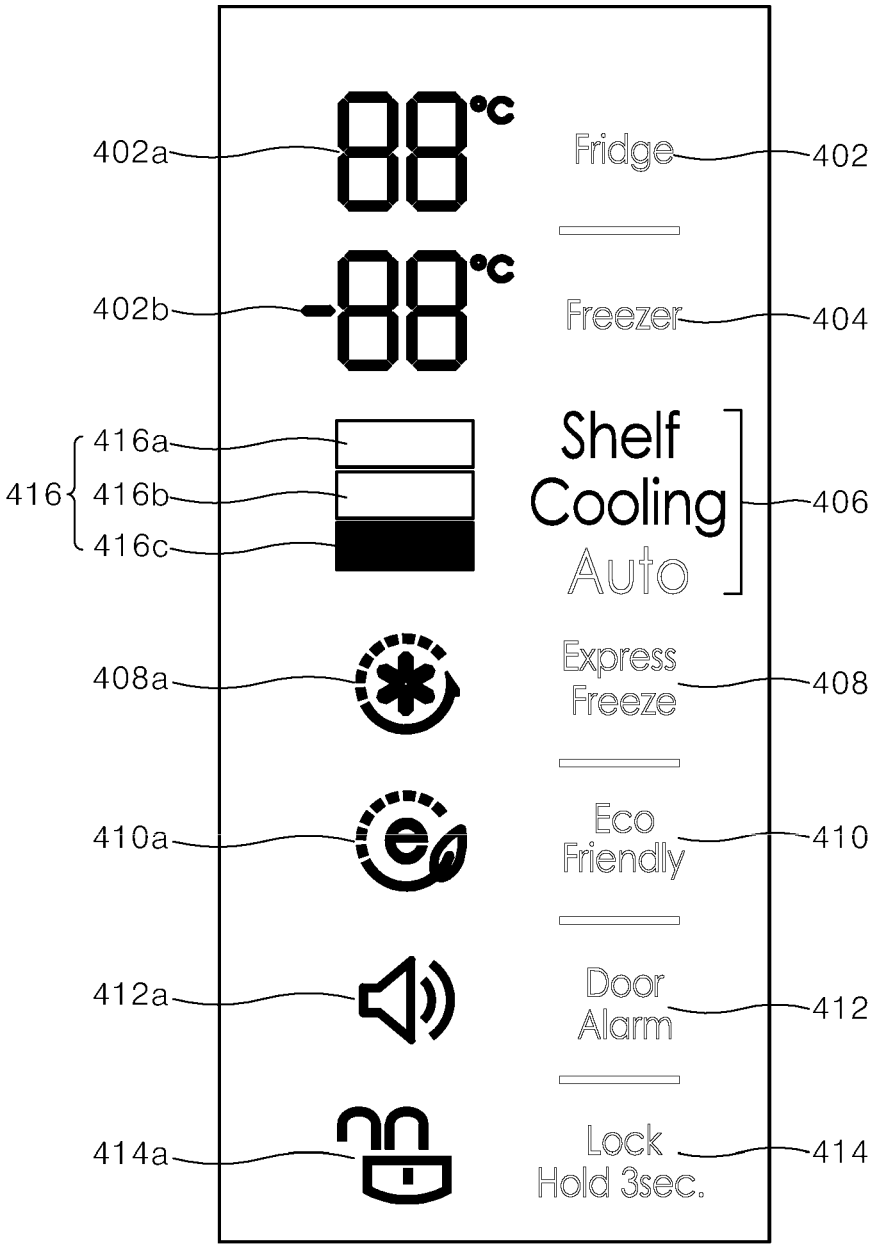
FIG. 18 is a configuration diagram illustrating the input portion and the display portion when the user selects the intensive cooling mode for the lower cell according to one embodiment of the present invention.

FIG. 18 is a configuration diagram illustrating the input portion and the display portion when the user selects the intensive cooling mode for the lower cell according to one embodiment of the present invention.

When the user touches the mode and shelf selection button 406 two times, as shown in FIG. 17, and touches the mode and shelf selection button 406 again, the areas of "shelf" and "cooling" remain in the turned-on state and a lower cell icon 416*c* of the intensive cooling shelf icons 416 is turned on, as shown in FIG. 18. This means that the refrigerator operates in the intensive cooling mode and the lower cell is selected as the object of intensive cooling.

That is, when the user touches the mode and shelf selection button 406 three times while the refrigerator operates in the general mode, as shown in FIG. 15, the refrigerator operates in the intensive cooling mode with respect to the lower cell. Accordingly, the controller 304 sets the lower cell to be the storage cell which is the object of cooling and performs the cooling operation with respect to the lower cell by opening the cold air outlet corresponding to the lower cell.

Figure 19:
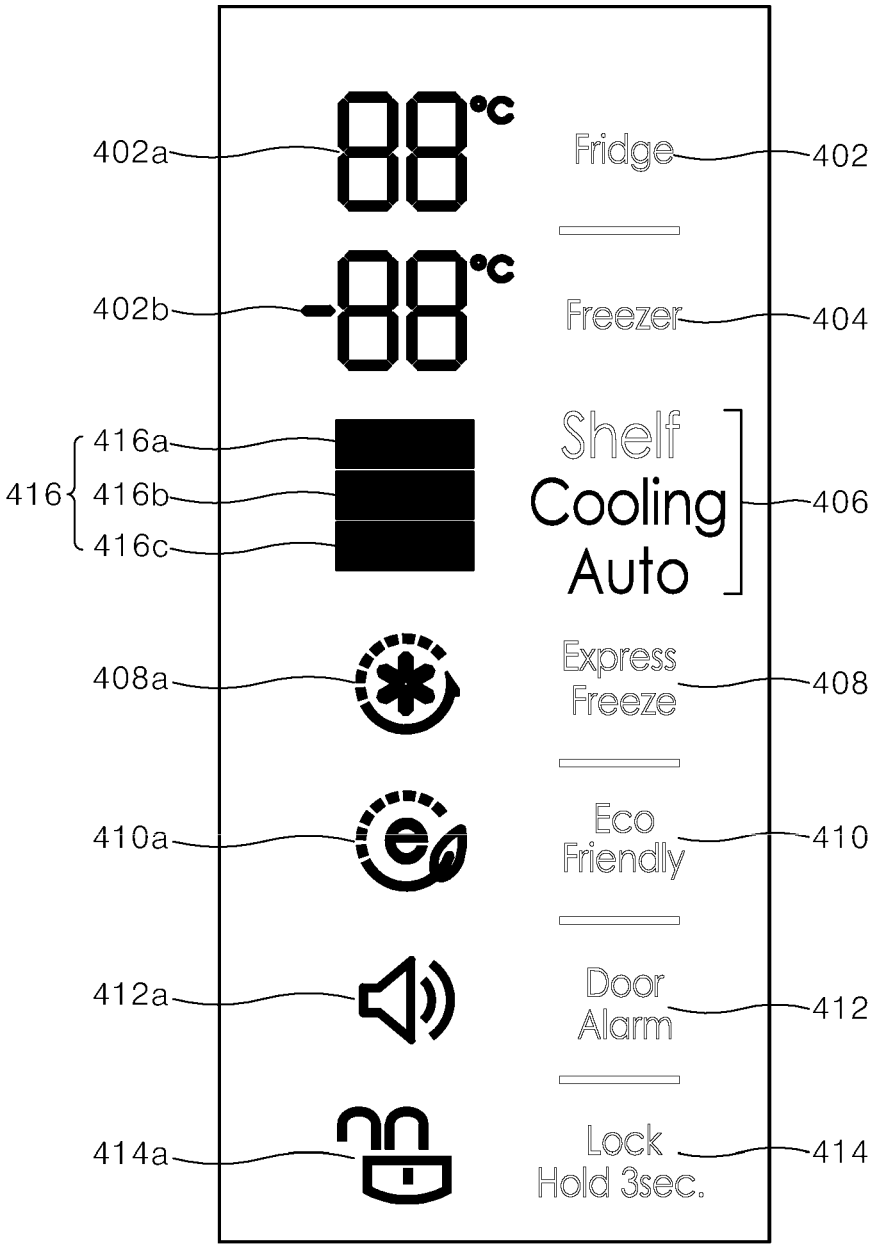
FIG. 19 is a configuration diagram illustrating the input portion and the display portion when the user selects an automatic cooling mode according to one embodiment of the present invention.

FIG. 19 is a configuration diagram illustrating the input portion and the display portion when the user selects the automatic cooling mode according to one embodiment of the present invention.

When the user touches the mode and shelf selection button 406 three times, as shown in FIG. 18, and touches the mode and shelf selection button 406 again, areas of "cooling" and "auto" are turned on, which means that the refrigerator operates in the automatic cooling mode. Also, as shown in FIG. 18, all of the intensive cooling shelf icons 416, that is, the upper cell icon 416*a*, the middle cell icon 416*b*, and the lower cell icon 416*c*, are turned on.

That is, when the user touches the mode and shelf selection button 406 four times while the refrigerator operates in the general mode, as shown in FIG. 15, the refrigerator operates in the automatic cooling mode. Accordingly, the controller 304 determines a storage cell which needs to be cooled to be the storage cell which is the object of cooling according to a temperature of each of the storage cells and automatically performs the cooling operation with respect to all or some of the storage cells. Here, the controller 304 may perform the cooling operation by opening the cold air outlet corresponding to the storage cell which is the object of cooling, as described above with reference to FIGS. 10 to 13.

Meanwhile, when the user touches the mode and shelf selection button 406 again while the refrigerator operates in the automatic cooling mode, as shown in FIG. 19, the refrigerator returns to a general operation mode, as shown in FIG. 15.

For example, the process of selecting the cooling mode and the storage cell which is the object of cooling, which has been described with reference to FIGS. 15 to 19, may vary according to an embodiment. For example, when the user touches the mode and shelf selection button 406 one time in the general operation mode, as shown in FIG. 15, the automatic cooling mode may be selected first, as shown in FIG. 19. As another example, when the user touches the mode and shelf selection button 406 one time in the general operation mode, as shown in FIG. 15, the intensive cooling mode for the lower cell may be selected first, as shown in FIG. 18.

Figure 20:
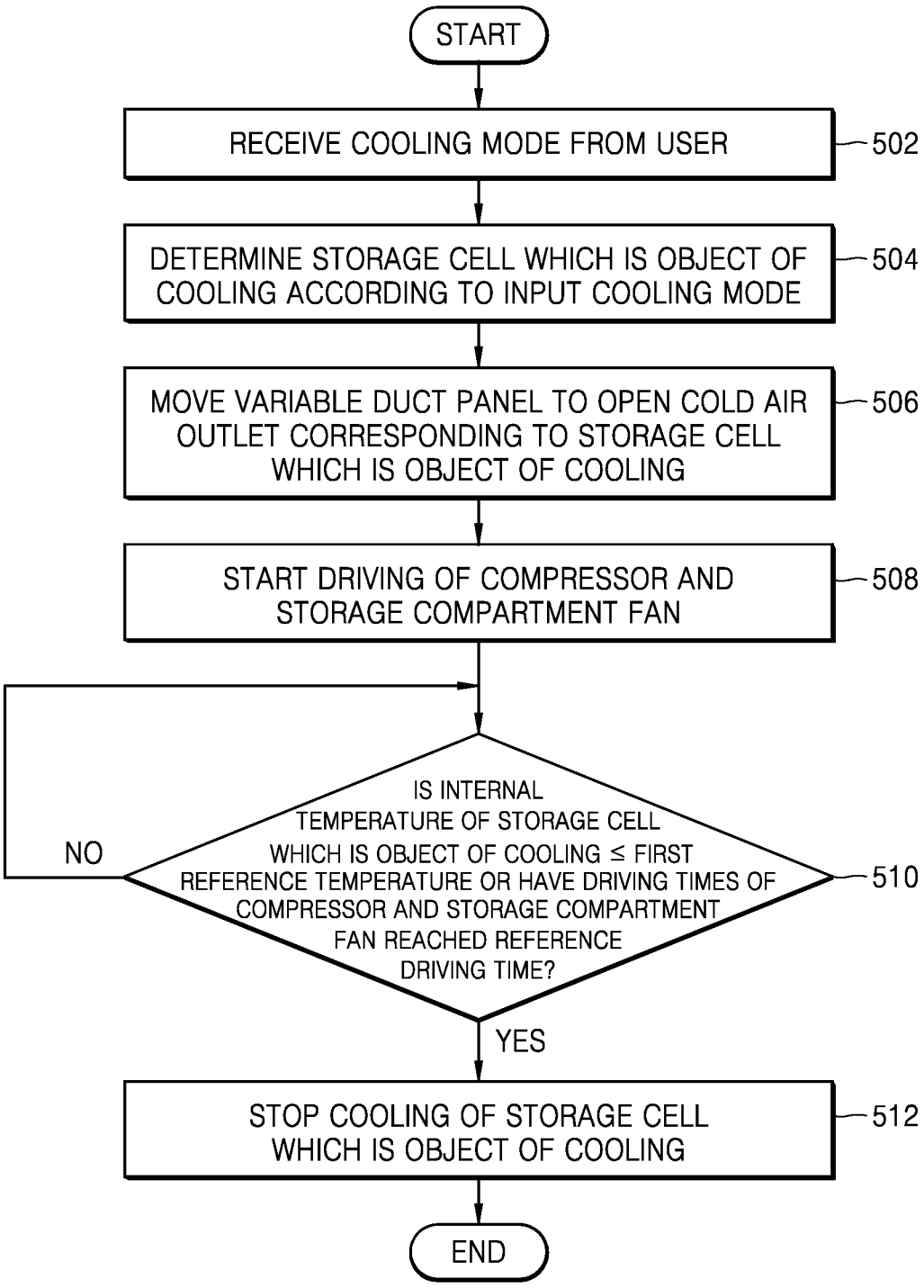
FIG. 20 is a flowchart illustrating a method of controlling the refrigerator according to one embodiment of the present invention.

FIG. 20 is a flowchart illustrating a method of controlling the refrigerator according to one embodiment of the present invention.

Referring to FIG. 20, first, the controller 304 of the refrigerator according to one embodiment of the present invention receives a cooling mode from a user through the input portion 302 (502). When the user inputs the cooling mode (502), the controller 304 determines a storage cell which is an object of cooling among storage cells according to the input cooling mode (504).

In one embodiment of the present invention, in the operation 504 of determining the object of cooling may include checking whether the cooling mode is the intensive cooling mode and determining a storage cell selected as an object of intensive cooling by the user to be the storage cell which is the object of cooling. That is, when the cooling mode is the intensive cooling mode, the storage cell selected by the user as the object of intensive cooling may be determined to be the storage cell which is the object of cooling.

Also, in another embodiment of the present invention, the operation 504 of determining the storage cell which is the object of cooling may include checking whether the cooling mode is the automatic cooling mode, checking an internal temperature of each of the storage cells, comparing the internal temperature of each of the storage cells with a preset second reference temperature, and determining the storage cell which is the object of cooling according to the number of storage cells having an internal temperature which exceeds the second reference temperature.

Here, the operation of determining the storage cell which is the object of cooling according to the number of storage cells having an internal temperature which exceeds the second reference temperature may include determining that any storage cell having an internal temperature which exceeds the second reference temperature is the storage cell which is the object of cooling when the number of storage cells having an internal temperature which exceeds the second reference temperature is lower than a preset reference number, and determining that all of the storage cells are storage cells which are objects of cooling when the number of storage cells having an internal temperature which exceeds the second reference temperature is the preset reference number or more.

Referring back to FIG. 20, when the storage cell which is the object of cooling is determined through the above-described process, the controller 304 moves the variable duct panel 134 to open a cold air outlet corresponding to the storage cell which is the object of cooling (506). For example, the controller 304 may open the cold air outlet corresponding to the storage cell which is the object of cooling by moving the variable duct panel 134 according to a position of the determined storage cell which is the object of cooling, as described above with reference to FIGS. 10 to 13.

Next, the controller 304 starts a cooling operation by driving the compressor 130 and the storage compartment fan 128 (508). Accordingly, the cooling operation with respect to the storage cell which is the object of cooling is performed through the open cold air outlet.

The controller 304 performs the cooling operation and checks the internal temperature of the storage cell with the open cold air outlet, that is, the storage cell which is the object of cooling. Also, the controller 304 checks driving times of the compressor 130 and the storage compartment fan 128 after starting to drive the compressor 130 and the storage compartment fan 128.

The controller 304 compares the internal temperature of the storage cell which is the object of cooling with a preset first reference temperature or compares the driving times of the compressor 130 and the storage compartment fan 128 with a preset reference driving time (510).

When it is determined that the internal temperature of the storage cell which is the object of cooling is the first reference temperature or lower or that the driving times of the compressor 130 and the storage compartment fan 128 reach the reference driving time as a result of the comparison, the controller 304 determines that the cooling of the storage cell which is the object of cooling is completed and stops the cooling thereof (512).

In one embodiment of the present invention, the operation 512 of stopping completing the cooling of the storage cell which is the object of cooling may include moving the variable duct panel 134 to close the cold air outlet corresponding to the storage cell which is the object of cooling. Also, in another embodiment of the present invention, the operation 512 of stopping the of the cooling of the storage cell which is the object of cooling may include stopping the driving of the compressor 130 and the storage compartment fan 128.

However, as the result of the comparison, when it is determined that the internal temperature of the storage cell which is the object of cooling is higher than the first reference temperature or the driving times of the compressor 130 and the storage compartment fan 128 do not reach the reference driving time, the controller 304 continuously performs the cooling operation of the storage cell which is the object of cooling.

Figure 21:
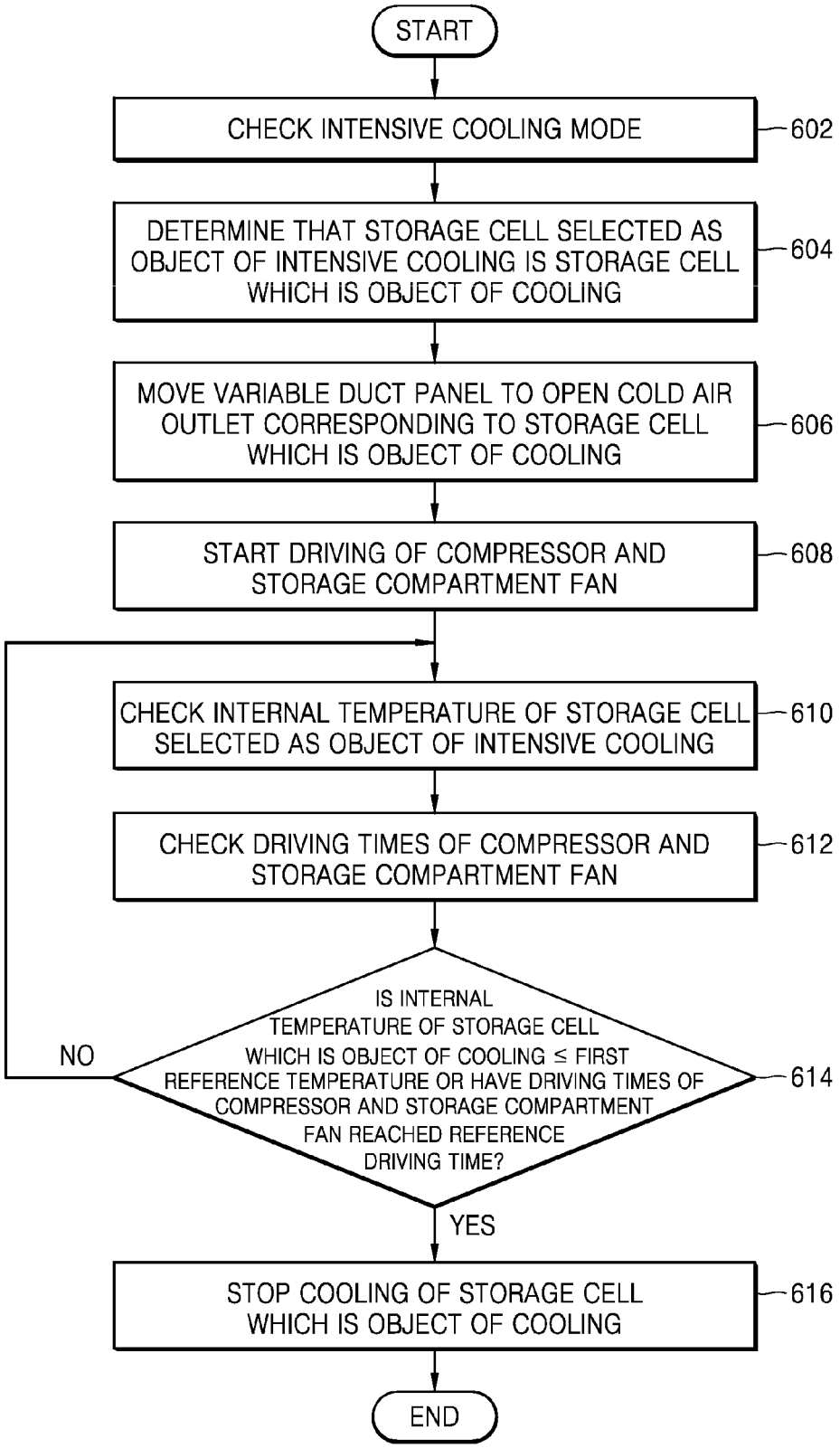
FIG. 21 is a flowchart illustrating a method of controlling the refrigerator when a user selects the intensive cooling mode according to one embodiment of the present invention.

FIG. 21 is a flowchart illustrating a method of controlling the refrigerator when a user selects an intensive cooling mode according to one embodiment of the present invention.

First, the controller 304 checks whether a mode selected by a user through the input portion 302 is the intensive cooling mode (602). Also, the controller 304 checks a storage cell selected by the user to be an object of intensive cooling through the input portion 302, and determines that the storage cell selected by the user to be the object of intensive cooling is a storage cell which is an object of cooling (604).

Next, the controller 304 moves the variable duct panel 134 to open a cold air outlet corresponding to the storage cell which is the object of cooling (606). After the cold air outlet corresponding to the storage cell which is the object of cooling is opened by moving the variable duct panel 134, the controller 304 starts a cooling operation with respect to the storage cell which is the object of cooling by driving the compressor 130 and the storage compartment fan 128 (608).

The controller 304 performs the cooling operation and checks an internal temperature of the storage cell which is the object of cooling (610). Also, the controller 304 checks driving times of the compressor 130 and the storage compartment fan 128 after starting to drive the compressor 130 and the storage compartment fan 128 (612).

The controller 304 compares the internal temperature of the storage cell which is the object of cooling with a preset first reference temperature or compares the driving times of the compressor 130 and the storage compartment fan 128 with a reference driving time (614). As a result of comparison, when it is determined that the internal temperature of the storage cell which is the object of cooling is the first reference temperature or lower or that the driving times of the compressor 130 and the storage compartment fan 128 reach the reference driving time, the controller 304 determines that the cooling of the storage cell which is the object of cooling to be completed and stops the cooling thereof (616). Here, the controller 304 may stops the cooling of the storage cell which is the object of cooling by moving the variable duct panel 134 to close the cold air outlet corresponding to the storage cell which is the object of cooling. Also, in another embodiment of the present invention, the controller 304 may stop the cooling of the storage cell which is the object of cooling by stopping the driving of the compressor 130 and the storage compartment fan 128.

However, as the result of the comparison in the operation 614, when it is determined that the internal temperature of the storage cell which is the object of cooling is higher than the first reference temperature or that the driving times of the compressor 130 and the storage compartment fan 128 do not reach the reference driving time, the controller 304 continuously performs the operations 610 to 614.

Figure 22:
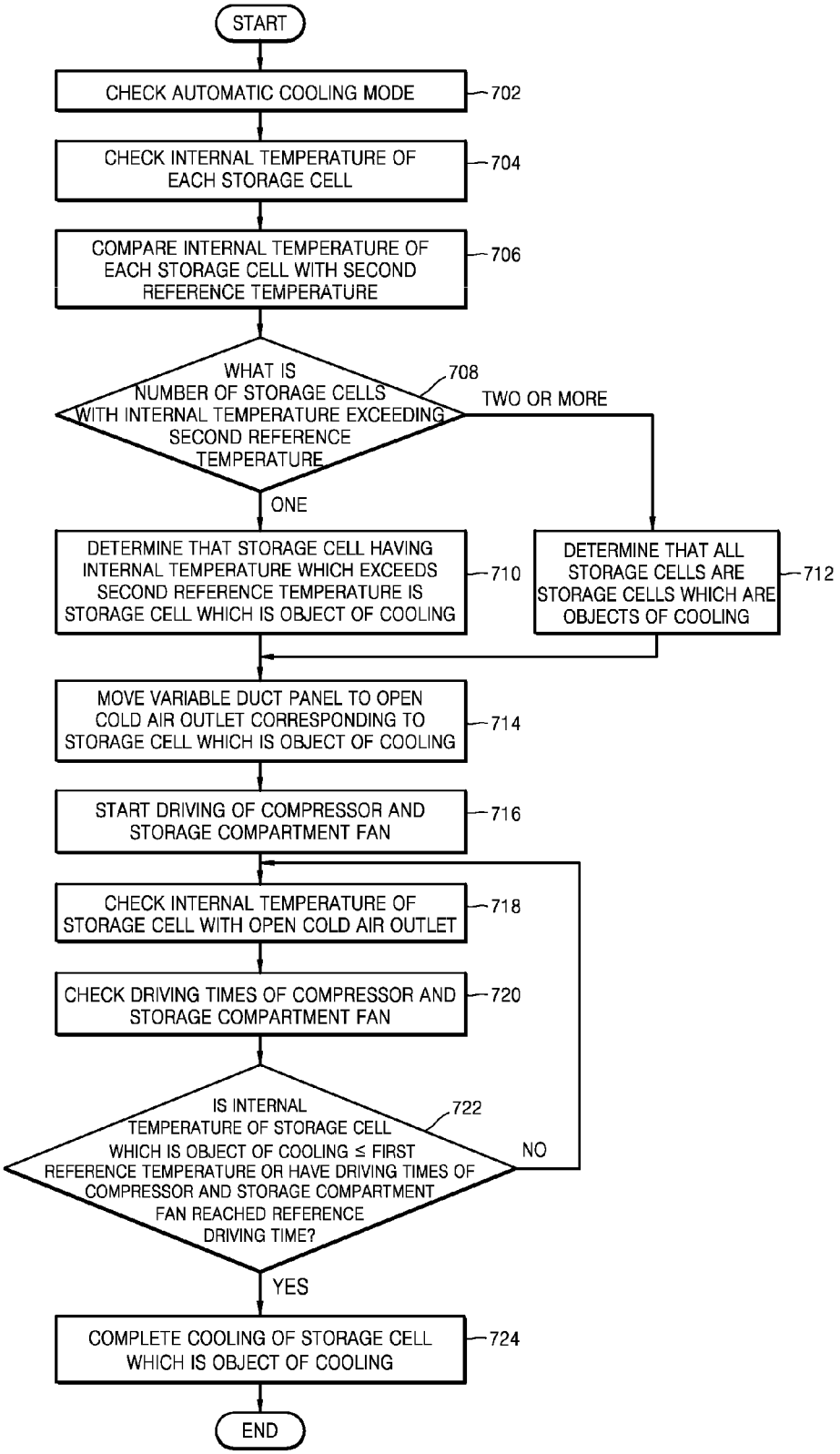
FIG. 22 is a flowchart illustrating a method of controlling the refrigerator when the user selects the automatic cooling mode according to one embodiment of the present invention.

FIG. 22 is a flowchart illustrating a method of controlling the refrigerator when the user selects an automatic cooling mode according to one embodiment of the present invention.

First, the controller 304 checks whether a mode selected by a user through the input portion 302 is the automatic cooling mode (702). Also, afterward, the controller 304 checks an internal temperature of each storage cell (704).

The controller 304 compares the checked internal temperature of each of the storage cells with a preset second reference temperature (706). As a result of the comparison in operation 706, when it is determined that the number of storage cells having an internal temperature which exceeds the second reference temperature is less than a preset reference number (for example, two), that is, when the number is one (one of 708), the controller 304 determines that a storage cell having an internal temperature which exceeds the second reference temperature is an object of cooling (710).

Meanwhile, as the result of the comparison in operation 706, when it is determined that the number of storage cells having an internal temperature which exceeds the second reference temperature is the preset reference number (for example, two) or more, that is, when the number is two or more (two or more of 708), the controller 304 determines that all of the storage cells are storage cells which are objects of cooling (712).

Here, the reference number may be differently set according to an embodiment.

Next, the controller 304 moves the variable duct panel 134 to open a cold air outlet corresponding to the storage cell which is the object of cooling (714). When the cold air outlet is opened through movement of the variable duct panel 134, the controller 304 starts the cooling operation by driving the compressor 130 and the storage compartment fan 128 (716).

The controller 304 performs the cooling operation and checks the internal temperature of the storage cell with the open cold air outlet, that is, the storage cell which is the object of cooling (718). Also, the controller 304 checks driving times of the compressor 130 and the storage compartment fan 128 after starting to drive the compressor 130 and the storage compartment fan 128 (720).

The controller 304 compares the internal temperature of the storage cell which is the object of cooling with a preset first reference temperature or compares the driving times of the compressor 130 and the storage compartment fan 128 with a reference driving time (722). As a result of the comparison, when it is determined that the internal temperature of the storage cell which is the object of cooling is the first reference temperature or lower or that the driving times of the compressor 130 and the storage compartment fan 128 reach the reference driving time, the controller 304 determines that the cooling of the storage cell which is the object of cooling is completed and stops the cooling thereof (724).

Here, the controller 304 may stop the cooling of the storage cell which is the object of cooling by moving the variable duct panel 134 to close the cold air outlet corresponding to the storage cell which is the object of cooling. Also, in another embodiment of the present invention, the controller 304 may stop the cooling of the storage cell which is the object of cooling by stopping the driving of the compressor 130 and the storage compartment fan 128.

However, as the result of comparison in the operation 722, when the internal temperature of the storage cell which is the object of cooling is higher than the first reference temperature or the driving times of the compressor 130 and the storage compartment fan 128 do not reach the reference driving time, the controller 304 continuously performs the operations 718 to 722.

According to the embodiments of the present invention, a multi-duct assembly, a refrigerator including the multi-duct assembly, and a method of controlling the refrigerator may provide an advantage of adjusting an opening state and a size of a cold air outlet as necessary.

According to the embodiments of the present invention, a multi-duct assembly, a refrigerator including the multi-duct assembly, and a method of controlling the refrigerator may provide an advantage of adjusting an opening state and size of a cold air outlet to cool a particular storage cell of a storage compartment according to a selection of a user or a temperature for each storage cell.

According to the embodiments of the present invention, a multi-duct assembly, a refrigerator including the multi-duct assembly, and a method of controlling the refrigerator may provide an advantage of preventing power consumption for unnecessarily cooling a storage cell and an overcooling phenomenon of stored items by adjusting an opening state and a size of a cold air outlet to cool a particular storage cell in consideration of a temperature for each storage cell.

Since the above-described embodiments of the present invention may be variously substituted, modified, and changed by one of ordinary skill in the art without departing from the scope of the technical concept of the present invention, the present invention is not limited to the above-described embodiments and the attached drawings.

What is claimed is:

1. A refrigerator comprising:

a body;

a storage compartment disposed in the body and comprising a plurality of storage cells;

a multi-duct assembly disposed on a surface of the storage compartment and comprising a plurality of cold air outlets, a cold air outlet of the plurality of cold air outlets located at a position corresponding to each of the storage cells;

an input portion configured to receive an input indicative of a cooling mode of the storage compartment; and a controller configured to adjust an area of at least one of the cold air outlets in the multi-duct assembly according to the cooling mode, wherein, when the cooling mode is an automatic cooling mode, the controller is configured to control the multi-duct assembly to open all the cold air outlets when a number of storage cells having an internal temperature that exceeds a preset reference temperature is greater than or equal to a preset reference number of storage cells, wherein the preset reference number of storage cells is less than a total number of storage cells in the storage compartment.

2. The refrigerator of claim 1, wherein the multi-duct assembly comprises:

a multi-duct panel disposed on the surface of the storage compartment, the multi-duct panel including the cold air outlets;

a variable duct panel disposed on the multi-duct panel, the variable duct panel being slidably movable relative to the multi-duct panel and configured to open and close one or more of the cold air outlets; and a driving unit configured to move the variable duct panel relative to the multi-duct panel.

3. The refrigerator of claim 2, wherein the variable duct panel includes at least one adjustable cold air opening.

4. The refrigerator of claim 3, wherein an area of the at least one adjustable cold air opening is larger than or equal to an area of an associated cold air outlet on the multi-duct panel.

5. The refrigerator of claim 3, wherein corners of the at least one adjustable cold air opening and the associated cold air outlet include curves having a preset curvature.

6. The refrigerator of claim 1, wherein, when the cooling mode is an automatic cooling mode, the controller is configured to open a cold air outlet corresponding to a storage cell having an internal temperature greater than or equal to the preset reference temperature.

7. The refrigerator of claim 1, wherein, when the cooling mode is an intensive cooling mode, the controller is configured to control the multi-duct assembly to open only a cold air outlet corresponding to a storage cell selected from among the storage cells to be an object of intensive cooling.

8. The refrigerator of claim 1, wherein, when the cooling mode is an automatic cooling mode, the controller is configured to control the multi-duct assembly to open only a cold air outlet corresponding to a storage cell having an internal temperature that exceeds the preset reference temperature when the number of storage cells having internal temperatures that exceed the preset reference temperature is less than the preset reference number.

9. The refrigerator of claim 1, wherein the controller controls the multi-duct assembly to allow an opening area of the cold air outlet to be an area corresponding to an amount of cold air which flows into the storage cell.

10. The refrigerator of claim 2, wherein the driving unit comprises:

a pinion gear engaged with a rack gear formed on one side of the variable duct panel; and a driving motor which rotates the pinion gear.

* * * * *